US011391094B2

(12) United States Patent
McCormack et al.

(10) Patent No.: US 11,391,094 B2
(45) Date of Patent: Jul. 19, 2022

(54) HYDRAULIC DRILLING SYSTEMS AND METHODS

(71) Applicant: PETROJET CANADA INC., Crossfield (CA)

(72) Inventors: Daniel Robert McCormack, Calgary (CA); Myles Brian McDougall, Calgary (CA); Brian Kenneth Stainthorpe, Cochrane (CA)

(73) Assignee: PETROJET CANADA INC., Crossfield (CA)

( * ) Notice: Subject to any disclaimer, the term of this patent is extended or adjusted under 35 U.S.C. 154(b) by 0 days.

(21) Appl. No.: 16/885,964

(22) Filed: May 28, 2020

(65) Prior Publication Data

US 2020/0318434 A1 Oct. 8, 2020

Related U.S. Application Data

(62) Division of application No. 15/319,295, filed as application No. PCT/CA2014/050744 on Aug. 7, 2014, now Pat. No. 10,724,302.

(Continued)

(51) Int. Cl.
*E21B 7/06* (2006.01)
*E21B 7/18* (2006.01)

(Continued)

(52) U.S. Cl.
CPC ..... *E21B 7/061* (2013.01); *E21B 7/18* (2013.01); *E21B 23/01* (2013.01); *E21B 23/04* (2013.01); *E21B 29/06* (2013.01); *E21B 33/10* (2013.01)

(58) Field of Classification Search
CPC . E21B 7/061; E21B 7/18; E21B 23/04; E21B 17/05
See application file for complete search history.

(56) References Cited

U.S. PATENT DOCUMENTS 1,865,853 A 7/1932 Granville
3,191,697 A * 6/1965 Haines ..... C09K 8/72 175/81

(Continued)

FOREIGN PATENT DOCUMENTS

CA 2884394 A1 * 3/2014 ..... E21B 7/061
CA 2884394 A1 3/2014

(Continued)

OTHER PUBLICATIONS

International Search Report dated Sep. 15, 2009, for International Application No. PCT/CA2009/000652.

*Primary Examiner* — Jennifer H Gay
(74) *Attorney, Agent, or Firm* — Bennett Jones LLP

(57) ABSTRACT

A hydraulic drilling system and method for drilling a borehole from a wellbore are disclosed. The system comprises a whipstock that is selectively rotatable about the central long axis of the work string, for repositioning the whipstock exit radially, without extracting the whipstock or the workstring from the wellbore. The system includes an extendable and contractible second work string for absorbing any axial forces on the work string. The system may also include a positional measurement device and the distal end of the drill tubing may be selectively steerable. The system may be used to drill a plurality of boreholes from the same wellbore. In one aspect of the method, an earth measurement device and/or an earth manipulation device is placed downhole.

11 Claims, 20 Drawing Sheets

Related U.S. Application Data

(60) Provisional application No. 62/013,134, filed on Jun. 17, 2014.

(51) Int. Cl.

| | |
|---|---|
| ***E21B 23/04*** | (2006.01) |
| ***E21B 23/01*** | (2006.01) |
| ***E21B 29/06*** | (2006.01) |
| ***E21B 33/10*** | (2006.01) |

(56) References Cited

U.S. PATENT DOCUMENTS

| | | | | |
|---|---|---|---|---|
| 3,194,327 | A * | 7/1965 | Smithson | E21B 7/061 175/61 |
| 3,599,733 | A | 8/1971 | Varley | |
| 3,602,310 | A | 8/1971 | Halbert | |
| 3,765,788 | A | 10/1973 | Pence, Jr. | |
| 4,007,797 | A | 2/1977 | Jeter | |
| 4,244,116 | A | 1/1981 | Barriac | |
| 4,307,781 | A | 12/1981 | Preston, Jr. et al. | |
| 4,377,207 | A * | 3/1983 | Kofahl | E21B 23/04 166/212 |
| 4,431,069 | A | 2/1984 | Dickinson et al. | |
| 4,527,639 | A | 7/1985 | Dickinson et al. | |
| 4,529,939 | A | 7/1985 | Kuckes | |
| 4,612,987 | A * | 9/1986 | Cheek | E21B 4/18 166/212 |
| 4,640,353 | A | 2/1987 | Schuh | |
| 4,693,327 | A | 9/1987 | Dickinson et al. | |
| 4,763,731 | A | 8/1988 | Dickinson et al. | |
| 4,763,734 | A * | 8/1988 | Dickinson | E21B 7/061 166/117.5 |
| 4,790,380 | A | 12/1988 | Ireland et al. | |
| 4,872,509 | A | 10/1989 | Dickinson et al. | |
| 4,886,118 | A | 12/1989 | Van Meurs et al. | |
| 5,255,750 | A | 10/1993 | Wilkes, Jr. et al. | |
| 5,343,152 | A | 8/1994 | Kuckes | |
| 5,373,906 | A | 12/1994 | Braddick | |
| 5,388,651 | A | 2/1995 | Berry | |
| 5,398,754 | A | 3/1995 | Dinhoble | |
| 5,421,420 | A | 6/1995 | Malone et al. | |
| 5,467,819 | A | 11/1995 | Braddick | |
| 5,579,829 | A | 12/1996 | Comeau et al. | |
| 5,687,806 | A | 11/1997 | Sallwasser et al. | |
| 5,704,437 | A | 1/1998 | Murray | |
| 5,730,221 | A | 3/1998 | Longbottom et al. | |
| 6,119,782 | A * | 9/2000 | Flores | E21B 49/10 166/382 |
| 6,142,246 | A | 11/2000 | Dickinson et al. | |
| 6,189,629 | B1 | 2/2001 | McLeod et al. | |
| 6,227,313 | B1 * | 5/2001 | Davis | E21B 4/18 175/89 |
| 6,263,984 | B1 | 7/2001 | Buckman, Sr. | |
| 6,547,540 | B1 | 4/2003 | Horng et al. | |
| 6,745,855 | B2 | 6/2004 | Gardes | |
| 6,968,904 | B2 * | 11/2005 | Bakke | E21B 17/1057 166/382 |
| 7,284,614 | B2 | 10/2007 | Van Helvoirt | |
| 7,455,127 | B2 | 11/2008 | Schick | |
| 7,481,282 | B2 | 1/2009 | Horst et al. | |
| 7,909,118 | B2 * | 3/2011 | Santel | E21B 47/024 175/62 |
| 8,141,659 | B2 * | 3/2012 | Peters | E21B 7/061 175/62 |
| 8,295,651 | B2 | 10/2012 | Hu et al. | |
| 8,528,644 | B2 * | 9/2013 | Brunet | E21B 17/20 166/298 |
| 8,813,856 | B1 | 8/2014 | Brunet et al. | |
| 9,493,988 | B2 | 11/2016 | Phillips | |
| 9,976,351 | B2 * | 5/2018 | Randall | E21B 23/14 |
| 10,060,211 | B2 * | 8/2018 | Sonar | E21B 7/068 |
| 10,227,825 | B2 * | 3/2019 | Randall | E21B 41/0078 |
| 10,260,299 | B2 * | 4/2019 | Randall | E21B 7/061 |
| 10,309,205 | B2 * | 6/2019 | Randall | E21B 41/0078 |
| 10,683,740 | B2 * | 6/2020 | Randall | E21B 43/267 |
| 10,724,302 | B2 * | 7/2020 | McCormack | E21B 7/18 |
| 10,954,769 | B2 * | 3/2021 | Randall | E21B 7/061 |
| 2002/0043404 | A1 | 4/2002 | Trueman et al. | |
| 2002/0070018 | A1 | 6/2002 | Buyaert | |
| 2003/0024710 | A1 * | 2/2003 | Post | E21B 23/04 166/382 |
| 2004/0154809 | A1 * | 8/2004 | Bakke | E21B 23/04 166/382 |
| 2004/0245020 | A1 | 12/2004 | Giroux et al. | |
| 2006/0180318 | A1 * | 8/2006 | Doering | E21B 4/18 166/384 |
| 2007/0125577 | A1 | 6/2007 | Brunet | |
| 2007/0289741 | A1 | 12/2007 | Rambow | |
| 2008/0029276 | A1 * | 2/2008 | Templeton | E21B 7/061 166/385 |
| 2009/0173544 | A1 | 7/2009 | Peters | |
| 2009/0218143 | A1 | 9/2009 | Sanfelice et al. | |
| 2010/0224367 | A1 | 9/2010 | Brunet et al. | |
| 2010/0270080 | A1 | 10/2010 | Perry et al. | |
| 2010/0307830 | A1 | 12/2010 | Curlett | |
| 2011/0083900 | A1 * | 4/2011 | Lavrut | E21B 4/18 175/57 |
| 2011/0203847 | A1 * | 8/2011 | Randall | E21B 29/06 175/50 |
| 2011/0247817 | A1 | 10/2011 | Bass et al. | |
| 2011/0247828 | A1 | 10/2011 | Patel et al. | |
| 2012/0048567 | A1 | 3/2012 | June | |
| 2012/0067646 | A1 | 3/2012 | Savage | |
| 2012/0118562 | A1 | 5/2012 | McAfee et al. | |
| 2012/0119744 | A1 | 5/2012 | Habashy et al. | |
| 2013/0062125 | A1 | 3/2013 | Savage | |
| 2013/0168151 | A1 * | 7/2013 | Grigor | E21B 7/061 175/61 |
| 2013/0213716 | A1 | 8/2013 | Perry et al. | |
| 2014/0027109 | A1 | 1/2014 | Al-Buraik | |
| 2015/0240573 | A1 | 8/2015 | Jacobsen et al. | |
| 2015/0369022 | A1 | 12/2015 | Zhou | |
| 2016/0130895 | A1 * | 5/2016 | Sonar | E21B 7/067 175/230 |
| 2016/0153239 | A1 * | 6/2016 | Randall | E21B 23/14 166/308.1 |
| 2016/0160568 | A1 * | 6/2016 | Randall | E21B 43/26 175/26 |
| 2016/0160595 | A1 * | 6/2016 | Randall | E21B 43/26 166/243 |
| 2016/0160619 | A1 * | 6/2016 | Randall | E21B 7/18 166/184 |
| 2017/0130542 | A1 | 5/2017 | Savage | |
| 2017/0204667 | A1 | 7/2017 | McCormack et al. | |
| 2017/0306711 | A1 | 10/2017 | Hern et al. | |
| 2019/0153841 | A1 * | 5/2019 | Randall | E21B 43/26 |
| 2019/0162060 | A1 * | 5/2019 | Randall | E21B 7/18 |
| 2021/0079747 | A1 * | 3/2021 | Grindhaug | E21B 29/005 |

FOREIGN PATENT DOCUMENTS

| | | | | |
|---|---|---|---|---|
| CN | 2615322 | | 5/2004 | |
| CN | 1877074 | | 12/2006 | |
| EP | 1281834 | A1 * | 2/2003 | E21B 17/1014 |
| EP | 1857631 | A1 * | 11/2007 | E21B 7/068 |
| GB | 2329662 | A | 3/1999 | |
| RU | 2255196 | | 6/2005 | |
| RU | 2315166 | C1 | 1/2008 | |
| RU | 2315167 | C1 | 1/2008 | |
| WO | WO 2004/035984 | A1 | 4/2004 | |
| WO | WO 2012/092404 | A1 | 7/2012 | |
| WO | WO 2013/045913 | A2 | 4/2013 | |
| WO | WO-2020058039 | A1 * | 3/2020 | E21B 27/04 |

* cited by examiner

HYDRAULIC DRILLING SYSTEMS AND METHODS

FIELD

This invention pertains generally to hydraulic drilling systems and methods and, more particularly, to systems and methods for performing various borehole drilling, earth measurement, and earth manipulation operations down hole.

BACKGROUND

U.S. Pat. No. 1,865,853 relates to the forming of boreholes from an existing wellbore by mechanical means to place a borehole tangentially from an existing wellbore using a rotational bit. Since then, many methods and systems in this area employ hose and nozzle technology to form the boreholes. However, these methods and systems fail to address a number of issues with the process of hydraulically forming boreholes from an existing wellbore.

First, to drill multiple boreholes in different orientations from the same axial location within an existing wellbore, whether the wellbore is vertical, horizontal or deviated, the work string must be rotated from surface using a rig. This process can be time consuming and expensive.

Second, when hydraulic pressure is applied to the work string, the pressure can cause the work string to lengthen due to piston force and shorten due to ballooning. Either of these conditions can be the dominate condition during the same operation depending on the pressure applied. If the pressure is varied during operations, the whipstock attached to the end of the work string can move axially in the wellbore. This axial movement can cause the drill string to be subject to additional bending and friction to remain in the borehole. If the movement is extreme the drill string can be caught in the borehole and potentially be broken off, thereby necessitating an expensive and time consuming retrieval process.

Third, the earth through which the borehole is to be placed is sometimes covered by well casing or liner and the casing or liner must be penetrated to extend the borehole into the earth. Conventional technology does not provide a one-step process for penetrating the casing or liner and placing a borehole.

Fourth, there is limited disclosure in the prior art about the potential uses for the boreholes. More specifically, many existing publications place great emphasis on borehole placement procedures and on the fluid used during the borehole placement process, but do not discuss what the borehole could be used for.

Fifth, existing technologies do not address the orientation and layout of multiple boreholes. It is conventional to place boreholes in vertical wells, which provides very little variety for borehole placement. Many new wells are deviated, horizontal or nearly horizontal, and these wells can stretch extended distances into the earth. The strategic placement of boreholes into these new wells may improve production and enhance the distribution of injection substances.

SUMMARY OF THE INVENTION

In accordance with a broad aspect of the present invention, there is provided a hydraulic drilling system for placement of boreholes for a wellbore having an inner surface, the system comprising: a first work string for placement down the wellbore, the first work string having an inner surface defining an axially extending bore, a proximate end, and a distal end; an upper section having an inner bore and a rotational device engaged to the proximate end of the first work string, and the position of the upper section is fixed relative to the wellbore; a whipstock provided at the distal end of the first work string, the whipstock having a whipstock exit and an inner bore providing a passage from the bore of the first work string to the whipstock exit; an activatable anchor for engaging the inner surface of the wellbore when activated to anchor the whipstock; a second work string that is extendable and contractible in an axial direction of the first work string, the second work string forms a length of the first work string at an axial location between the proximate end and the distal end of the first work string, for accommodating at least a portion of any axial forces on the first work string; a movement control device; and a drill tubing extending inside the first work string and having an inner bore leading to an opening at a distal end of the drill tubing, and the drill tubing being extendable through the inner bore of the whipstock, such that with the opening is extendable through the whipstock exit, the advancement and retraction of the drill tubing relative to the whipstock being controlled by the movement control device, the rotational device is activate-able to rotate the whipstock, via the first work string, about a central long axis of the first work string, for repositioning the whipstock exit radially relative to the long central axis, and the drill tubing allowing fluid to pass therethrough via the upper section.

In accordance with another broad aspect of the present invention, there is provided a hydraulic drilling system for use with a wellbore having an inner surface and at least one borehole extending radially therefrom, the system comprising: a first work string for placement down the wellbore, the first work string having an inner surface defining an axially extending bore, a proximate end, and a distal end; an upper section having an inner bore, the upper section being engaged to the proximate end of the first work string, and the position of the upper section being fixed relative to the wellbore; a whipstock provided at the distal end of the first work string, the whipstock having a whipstock exit and an inner bore providing a passage from the bore of the first work string to the whipstock exit; a drill tubing extending inside the first work string and having an inner bore leading to an opening at a distal end of the drill tubing, and the drill tubing being extendable through the inner bore of the whipstock, such that with the opening is extendable through the whipstock exit, and the drill tubing allowing fluid to pass therethrough via the upper section; and a positional measurement device for determining the location of one or more of: the at least one borehole, the whipstock exit, and the distal end of the drill tubing.

In accordance with another broad aspect of the present invention, there is provided a hydraulic drilling system for use with a wellbore having an inner surface, the system comprising: a first work string for placement down the wellbore, the first work string having an inner surface defining an axially extending bore, a proximate end, and a distal end; an upper section having an inner bore, the upper section being engaged to the proximate end of the first work string and the position of the upper section being fixed relative to the wellbore; a whipstock provided at the distal end of the first work string, the whipstock having a whipstock exit and an inner bore providing a passage from the bore of the first work string to the whipstock exit; a drill tubing extending inside the first work string, defining an annulus therebetween, and having an inner bore leading to an opening at a distal end of the drill tubing, and the drill tubing being extendable through the inner bore of the whipstock, such that with the opening is extendable through the whipstock exit, and the drill tubing allowing fluid to pass therethrough via the upper section; a lower seal for fluidly sealing the interface between the drill tubing and the whipstock inner bore; and a passage through the lower seal allowing fluid communication between the annulus and the whipstock.

In accordance with another broad aspect of the present invention, there is provided a hydraulic drilling system for use with a wellbore having an inner surface, the system comprising: a first work string for placement down the wellbore, the first work string having an inner surface defining an axially extending bore, a proximate end, and a distal end; an upper section having an inner bore, the upper section being engaged to the proximate end of the first work string and the position of the upper section being fixed relative to the wellbore; a whipstock provided at the distal end of the first work string, the whipstock having a whipstock exit and an inner bore providing a passage from the bore of the first work string to the whipstock exit; a drill tubing extending inside the first work string and having an inner bore leading to an opening at a distal end of the drill tubing, and the drill tubing being extendable through the inner bore of the whipstock, such that with the opening is extendable through the whipstock exit, and the drill tubing allowing fluid to pass therethrough via the upper section; and a lower seal for fluidly sealing the interface between the drill tubing and the whipstock inner bore, the lower seal having an inner bore, through which a portion of the drill tubing is extendible, and the distal end of the drill tubing is sized to have an overall diameter greater than the diameter of the lower seal inner bore.

In accordance with another broad aspect of the present invention, there is provided a hydraulic drilling system for use with a wellbore having an inner surface, the system comprising: a first work string for placement down the wellbore, the first work string having an inner surface defining an axially extending bore, a proximate end, and a distal end; an upper section having an inner bore, the upper section being engaged to the proximate end of the first work string and the position of the upper section being fixed relative to the wellbore; a whipstock provided at the distal end of the first work string, the whipstock having a whipstock exit having an inner diameter and a deflection assembly having an inner bore providing a passage from the bore of the first work string to the whipstock exit, the inner bore of the deflection assembly having an inner diameter; and a drill tubing extending inside the first work string and having an inner bore leading to an opening at a distal end of the drill tubing, a portion of the drill tubing being extended through the inner bore of the deflection assembly with the distal end extended through and outside the inner bore of the deflection assembly, the inner bore of the deflection assembly for guiding the drill tubing towards the whipstock exit as the drill tubing advances therethrough; and the distal end of the drill tubing is sized to have an overall diameter greater than the inner diameter of the inner bore of the deflection assembly.

In accordance with another broad aspect of the present invention, there is provided a hydraulic drilling system for use with a wellbore having an inner surface, the system comprising: a first work string for placement down the wellbore, the first work string having an inner surface defining an axially extending bore, a proximate end, and a distal end; an upper section having an inner bore, the upper section being engaged to the proximate end of the first work string and the position of the upper section being fixed relative to the wellbore; a whipstock provided at the distal end of the first work string, the whipstock having a whipstock exit and an inner bore providing a passage from the bore of the first work string to the whipstock exit; a drill tubing extending inside the first work string and having an inner bore leading to an opening at a distal end of the drill tubing, and the drill tubing being extendable through the inner bore of the whipstock, such that with the opening is extendable through the whipstock exit, and the drill tubing allowing fluid to pass therethrough via the upper section; and a plurality of acoustic sensors installed near the distal end of the first work string for sensing sound of fluid exiting the opening of the drill tubing and generating data signals for calculating the location of the distal end of the drill tubing.

In accordance with another broad aspect of the present invention, there is provided a hydraulic drilling system for use with a wellbore having an inner surface, the system comprising: a first work string for placement down the wellbore, the first work string having an inner surface defining an axially extending bore, a proximate end, and a distal end; an upper section having an inner bore, the upper section being engaged to the proximate end of the first work string and the position of the upper section being fixed relative to the wellbore; a whipstock provided at the distal end of the first work string, the whipstock having a whipstock exit and an inner bore providing a passage from the bore of the first work string to the whipstock exit; a drill tubing extending inside the first work string and having an inner bore leading to an opening at a distal end of the drill tubing, and the drill tubing being extendable through the inner bore of the whipstock, such that with the opening is extendable through the whipstock exit, and the drill tubing allowing fluid to pass therethrough via the upper section; a magnetic source installed at the distal end of the drill tubing, the magnetic source having a magnetic field; and a plurality of magnetic sensors installed near the distal end of the first work string for sensing the magnetic field of the magnetic source and generating data signals for calculating the location of the distal end of the drill tubing.

In accordance with another broad aspect of the present invention, there is provided a hydraulic drilling system for use with a wellbore having an inner surface, the system comprising: a first work string for placement down the wellbore, the first work string having an inner surface defining an axially extending bore, a proximate end, and a distal end; an upper section having an inner bore, the upper section being engaged to the proximate end of the first work string and the position of the upper section being fixed relative to the wellbore; a whipstock provided at the distal end of the first work string, the whipstock having a whipstock exit and an inner bore providing a passage from the bore of the first work string to the whipstock exit; a drill tubing extending inside the first work string and having an inner bore leading to an opening at a distal end of the drill tubing, and the drill tubing being extendable through the inner bore of the whipstock, such that with the opening is extendable through the whipstock exit, the drill tubing allowing fluid to pass therethrough via the upper section; at least one selectively openable side port at or near the distal end of the drill tubing, and when the at least one side port is open and a fluid from the drill tubing passes through therethrough, a high pressure fluid jet is generated and is sufficient to steer the distal end of the drill tubing in a direction away from the exit direction of the high pressure fluid jet; and a positional device installed in the drill tubing for controlling the opening and closing the at least one side port.

In accordance with another broad aspect of the present invention, there is provided a hydraulic drilling system for use with a wellbore having an inner surface, the system comprising: a first work string for placement down the wellbore, the first work string having an inner surface defining an axially extending bore, a proximate end, and a distal end; an upper section having an inner bore, the upper section being engaged to the proximate end of the first work string and the position of the upper section being fixed relative to the wellbore; a whipstock provided at the distal end of the first work string, the whipstock having a whipstock exit and an inner bore providing a passage from the bore of the first work string to the whipstock exit; a movement control device; a pair of swivels between which the whipstock is mounted, thereby allowing the whipstock to rotate freely about its long central axis; and a drill tubing extending inside the first work string and having an inner bore leading to an opening at a distal end of the drill tubing, and the drill tubing being extendable through the inner bore of the whipstock, such that with the opening is extendable through the whipstock exit, the advancement and retraction of the drill tubing relative to the whipstock being controlled by the movement control device, and the drill tubing allowing fluid to pass therethrough via the upper section.

In accordance with another broad aspect of the present invention, there is provided a hydraulic drilling system for use with a wellbore having an inner surface, the system comprising: a first work string for placement down the wellbore, the first work string having an inner surface defining an axially extending bore, a proximate end, and a distal end; an upper section having an inner bore, the upper section being engaged to the proximate end of the first work string and the position of the upper section being fixed relative to the wellbore; a whipstock provided at the distal end of the first work string, the whipstock having a whipstock exit and an inner bore providing a passage from the bore of the first work string to the whipstock exit; a movement control device; wheels or treads on an outer surface of the whipstock for frictionally engaging the inner surface of the wellbore; a drive mechanism coupled to the whipstock for driving the wheels or treads; and a drill tubing extending inside the first work string and having an inner bore leading to an opening at a distal end of the drill tubing, and the drill tubing being extendable through the inner bore of the whipstock, such that with the opening is extendable through the whipstock exit, the advancement and retraction of the drill tubing relative to the whipstock being controlled by the movement control device, the whipstock being selectively actively conveyable in an axial direction relative to the wellbore by operation of the drive mechanism, and the drill tubing allowing fluid to pass therethrough via the upper section.

In accordance with another broad aspect of the present invention, there is provided a method of hydraulic drilling in a wellbore comprising: running a first work string down the wellbore, the first work string having an inner surface defining an axially extending bore, a proximate end, and a distal end, the proximate end of the first work string being engaged to an upper section having an inner bore, the position of the upper section being fixed relative to the wellbore, the distal end of the first work string having a whipstock, the whipstock having a whipstock exit and an inner bore providing a passage from the bore of the first work string to the whipstock exit, the whipstock being coupled to a rotational device activatable to rotate the whipstock about a central long axis of the first work string, and the first work string including a second work string that forms a length thereof, the second work string being between the proximate end and the distal end of the first work string, and being extendable and contractible in an axial direction of the first work string for accommodating at least a portion of any forces in the axial direction; extending a drill tubing inside the first work string, the drill tubing having an inner bore leading to an opening at a distal end of the drill tubing; inserting at least a portion of the drill tubing through the whipstock; anchoring the first work string against an inner surface of the wellbore; and introducing pressurized drilling fluid into the drill tubing and discharging the fluid through the opening of the drill tubing.

In accordance with another broad aspect of the present invention, there is provided a method of obtaining location data in a wellbore comprising: running a first work string down the wellbore, the first work string having an inner surface defining an axially extending bore, a proximate end, and a distal end, the proximate end of the first work string being engaged to an upper section having an inner bore, the position of the upper section being fixed relative to the wellbore, the distal end of the first work string having a whipstock, the whipstock having a whipstock exit and an inner bore providing a passage from the bore of the first work string to the whipstock exit; extending a drill tubing inside the first work string, the drill tubing having an inner bore leading to an opening at a distal end of the drill tubing; and determining the location of one or more of: a borehole, the whipstock exit, and the distal end of the drill tubing, using a positional measurement device.

In accordance with another broad aspect of the present invention, there is provided a method of hydraulic drilling in a wellbore comprising: running a first work string down the wellbore, the first work string having an inner surface defining an axially extending bore, a proximate end, and a distal end, the proximate end of the first work string being engaged to an upper section having an inner bore, the position of the upper section being fixed relative to the wellbore, the distal end of the first work string having a whipstock, the whipstock having a whipstock exit and an inner bore providing a passage from the bore of the first work string to the whipstock exit; extending a drill tubing inside the first work string, the drill tubing having an inner bore leading to a rotatable drill head at a distal end of the drill tubing, the drill head providing an opening in communication with the inner bore of the drill tubing; inserting at least a portion of the drill tubing through the whipstock; introducing pressurized drilling fluid into the drill tubing; and ejecting the pressurized drilling fluid from the drill head and rotating the drill head, thereby cutting a borehole from the inner surface of the wellbore and allowing the drill head to advance into the borehole.

In accordance with another broad aspect of the present invention, there is provided a method of hydraulic drilling in a substantially horizontal wellbore comprising: running a first work string down the wellbore, the first work string having an inner surface defining an axially extending bore, a proximate end, and a distal end, the proximate end of the first work string being engaged to an upper section having an inner bore, the position of the upper section being fixed relative to the wellbore, the distal end of the first work string having a whipstock, the whipstock having a whipstock exit and an inner bore providing a passage from the bore of the first work string to the whipstock exit; extending a drill tubing inside the first work string, the drill tubing having an inner bore leading to an opening at a distal end of the drill tubing; inserting at least a portion of the drill tubing through the whipstock; anchoring the first work string against an inner surface of the wellbore; introducing pressurized drilling fluid into the drill tubing and discharging the fluid through the opening of the drill tubing; cutting a first hole from the inner surface of the wellbore at a first preselected location of the wellbore with the pressurized drilling fluid exiting from the opening of the drill tubing, thereby allowing the distal end of the drill tubing to advance through the first hole; forming a first borehole extending from the first hole with the pressurized drilling fluid, the first borehole having a preselected length and a preselected trajectory; cutting a second hole from the inner surface of the wellbore at a second preselected location of the wellbore with the pressurized drilling fluid exiting from the opening of the drill tubing, thereby allowing the distal end of the drill tubing to advance through the second hole; and forming a second borehole extending from the second hole with the pressurized drilling fluid, the second borehole having a preselected length and a preselected trajectory, and wherein the first and second boreholes extend radially outwardly from the wellbore when viewed from one end of the wellbore, wherein (i) the first and second boreholes are spaced apart axially along the length of the wellbore; and/or (ii) the first and second boreholes define a radial angle therebetween when viewed from one end of the wellbore, and the angle is between about 0 degrees and about 180 degrees.

In accordance with another broad aspect of the present invention, there is provided a method of obtaining measurements in a wellbore comprising: running a first work string down the wellbore, the first work string having an inner surface defining an axially extending bore, a proximate end, and a distal end, the proximate end of the first work string being engaged to an upper section having an inner bore, the position of the upper section being fixed relative to the wellbore, the distal end of the first work string having a whipstock, the whipstock having a whipstock exit and an inner bore providing a passage from the bore of the first work string to the whipstock exit; extending a drill tubing inside the first work string, the drill tubing having an inner bore leading to an opening at a distal end of the drill tubing; inserting at least a portion of the drill tubing through the whipstock; anchoring the first work string against an inner surface of the wellbore; introducing pressurized drilling fluid into the drill tubing and discharging the fluid through the opening of the drill tubing; cutting a borehole from the inner surface of the wellbore with the pressurized drilling fluid exiting from the opening of the drill tubing, thereby allowing the distal end of the drill tubing to advance into the borehole; placing at least one earth measurement device in one or more of: the whipstock, the drill tubing, the borehole, and surrounding earth of the borehole; and taking measurements using the at least one earth measurement device.

In accordance with another broad aspect of the present invention, there is provided a method of earth manipulation in a borehole extending radially from a wellbore, the borehole having a proximate end at an inner surface of the wellbore and a distal end away from the wellbore, and earth surrounding the distal end of the borehole having an initial temperature, permeability, porosity, and rock wettability, the method comprising: extending a drill tubing inside the wellbore, the drill tubing having an inner bore leading to an opening at a distal end of the drill tubing; inserting the opening of the drill tubing into the borehole and positioning the opening of the drill tubing at or near the distal end of the borehole; supplying a fluid into the drill tubing and discharging the fluid through the opening of the drill tubing, the fluid having a temperature lower from the initial temperature, thereby changing the initial temperature to a new temperature; and ceasing the supply of the fluid in the drill tubing to allow the earth to return to the initial temperature.

In accordance with another broad aspect of the present invention, there is provided a method of hydraulic fracturing in a borehole extending radially from a wellbore having an inner surface, the borehole having a proximate end at an inner surface of the wellbore, a distal end away from the wellbore, and earth surrounding the borehole, the method comprising: running a first work string down the wellbore, the first work string having an outer surface, inner surface defining an axially extending bore, a proximate end, and a distal end, the proximate end of the first work string being engaged to an upper section having an inner bore, the position of the upper section being fixed relative to the wellbore, the distal end of the first work string having a whipstock, the whipstock having a whipstock exit and an inner bore providing a passage from the bore of the first work string to the whipstock exit, the outer surface of the first work string and the inner surface of the casing defining an annulus; extending a drill tubing inside the first work string, the drill tubing having an inner bore leading to an opening at a distal end of the drill tubing, at least a portion of the drill tubing extending through the whipstock; inserting the distal end of the drill tubing inside the borehole, via the whipstock exit; fluidly sealing at least a portion of the annulus, the at least a portion of the annulus in fluid communication with the borehole, thereby preventing fluid from exiting the wellbore; and generating or augmenting fractures in the earth surrounding the borehole by supplying a pressurized fluid into the drill tubing and injecting the pressurized fluid into the borehole through the opening of the drill tubing.

In accordance with another broad aspect of the present invention, there is provided a method of earth manipulation in a borehole extending radially from a wellbore, the borehole having a proximate end at an inner surface of the wellbore and a distal end away from the wellbore, and earth surrounding the borehole having an initial temperature, the method comprising: placing an earth manipulation device into the borehole, the earth manipulation device being one or more of: a resistive heating element, a microwave generating device, and an antenna; and activating the earth manipulation device to heat the earth to a new temperature that is higher than the initial temperature.

In accordance with another broad aspect of the present invention, there is provided a method of hydraulic drilling in a wellbore having a casing comprising: running a first work string down the wellbore, the first work string having an inner surface defining an axially extending bore, a proximate end, and a distal end, the proximate end of the first work string being engaged to an upper section having an inner bore, the position of the upper section being fixed relative to the wellbore, the distal end of the first work string having a whipstock, the whipstock having a whipstock exit and an inner bore providing a passage from the bore of the first work string to the whipstock exit; extending a drill tubing inside the first work string, the drill tubing having an inner bore leading to an opening at a distal end of the drill tubing; inserting at least a portion of the drill tubing through the whipstock; anchoring the first work string against an inner surface of the wellbore; introducing pressurized drilling fluid into the drill tubing and discharging the fluid through the opening of the drill tubing, the drilling fluid having abrasive material; directing the distal end of the drill tubing at the casing; cutting a hole in the casing using the discharged drilling fluid; extending the distal end of the drill tubing through the hole; and drilling an extended borehole from the hole using the pressurized drilling fluid.

BRIEF DESCRIPTION OF THE DRAWINGS

Drawings are included for the purpose of illustrating certain aspects of the invention. Such drawings and the description thereof are intended to facilitate understanding and should not be considered limiting of the invention. Drawings are included, in which.

DETAILED DESCRIPTION OF VARIOUS EMBODIMENTS

The detailed description set forth below in connection with the appended drawings is intended as a description of various embodiments of the present invention and is not intended to represent the only embodiments contemplated by the inventor. The detailed description includes specific details for the purpose of providing a comprehensive understanding of the present invention. However, it will be apparent to those skilled in the art that the present invention may be practiced without these specific details.

The system and method described herein allow the re-orientation of the whipstock (thus the re-direction of the drill head) without fully extracting the bottom hole assembly from the wellbore. The system and method are also configured to compensate for any axial work string movement due to fluctuations in fluid pressure during wellbore operations. These and other features of the present invention are described in detail herein below.

Figure 1:
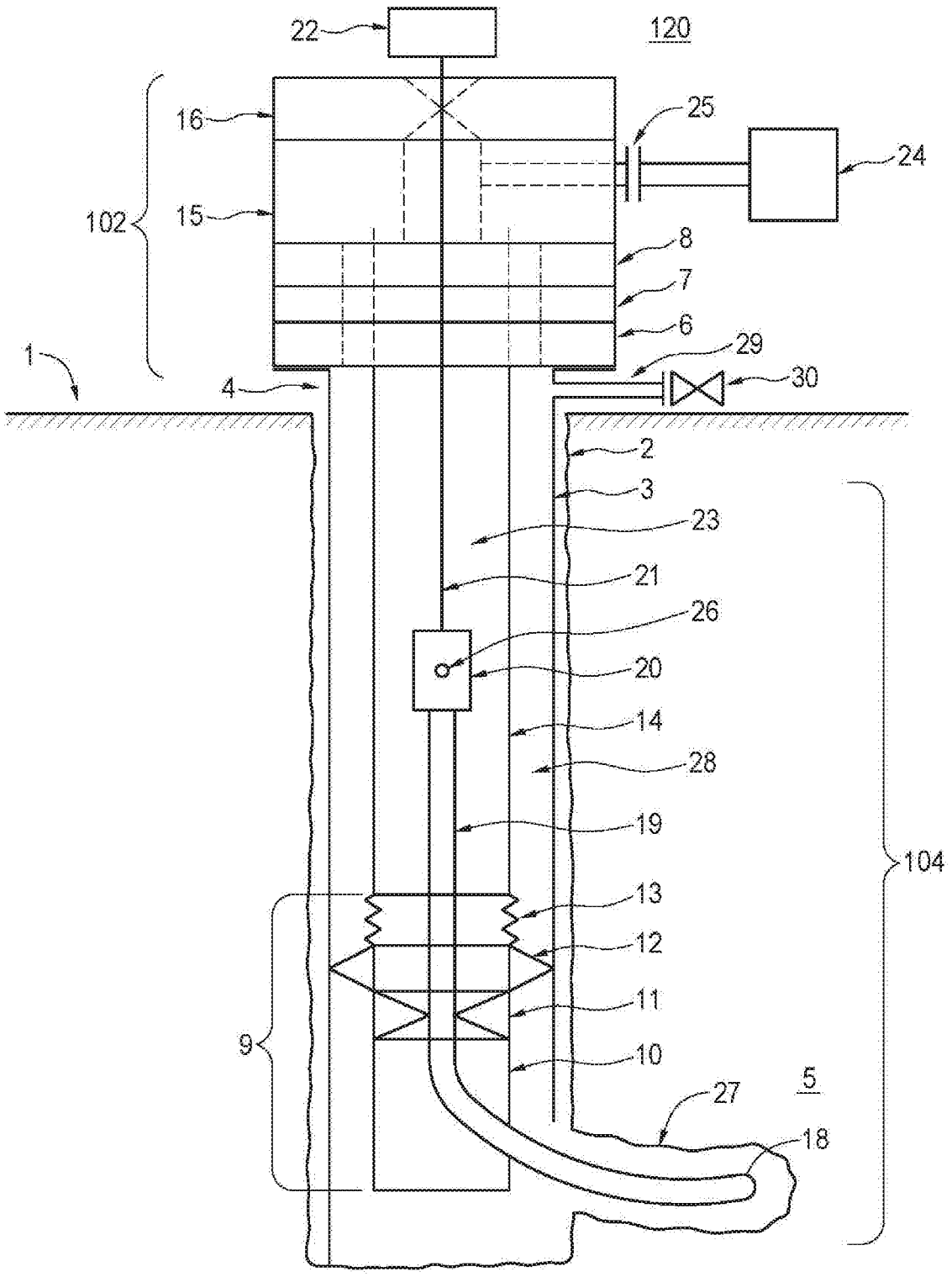
FIG. 1 is an elevation schematic view of a hydraulic drilling system according to an embodiment of the present invention.
Figure 3:
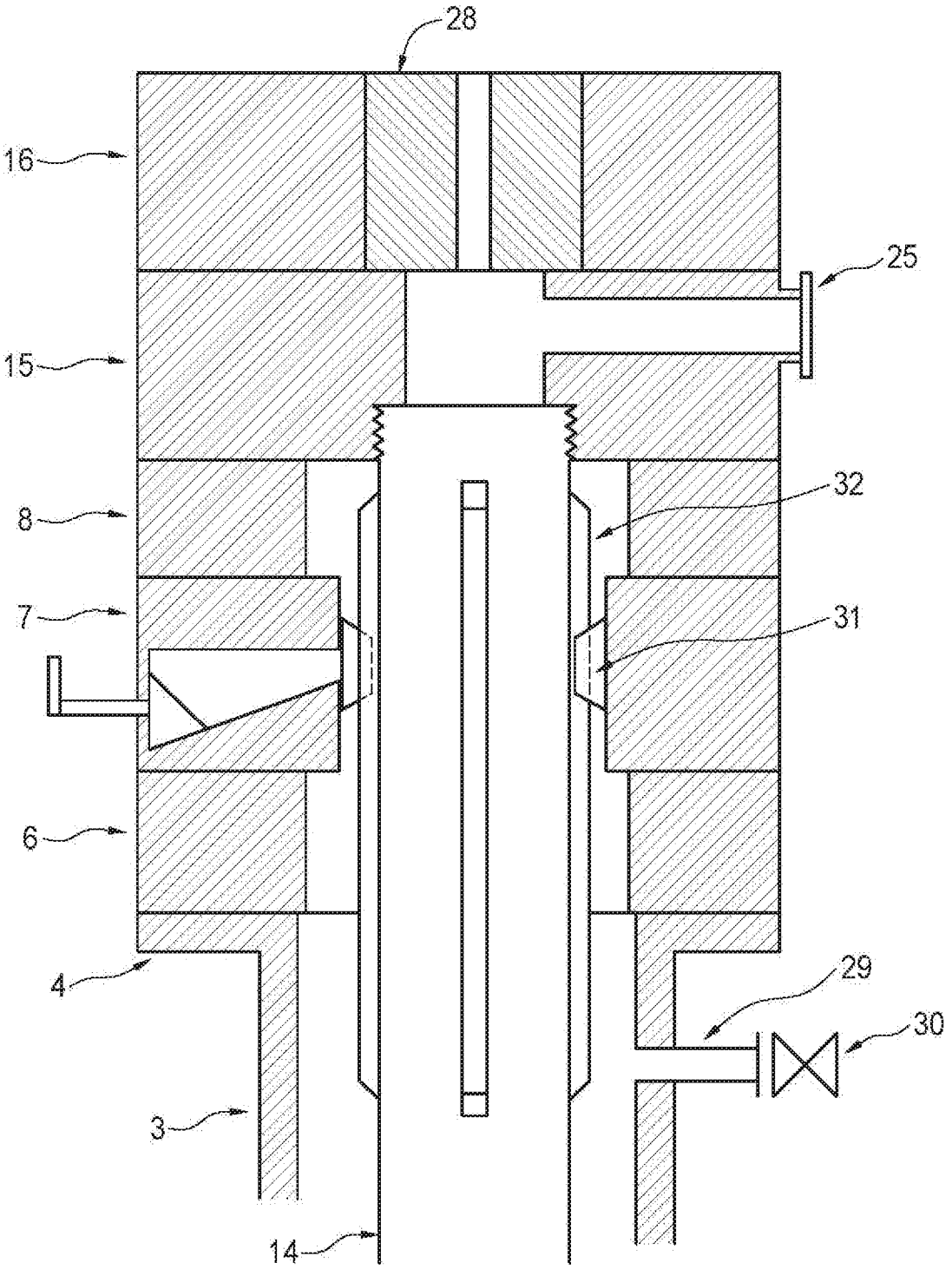
FIG. 3 is a cross-section view of above surface equipment of the hydraulic drilling system shown in FIG. 1 and FIG. 2.
Figure 5:
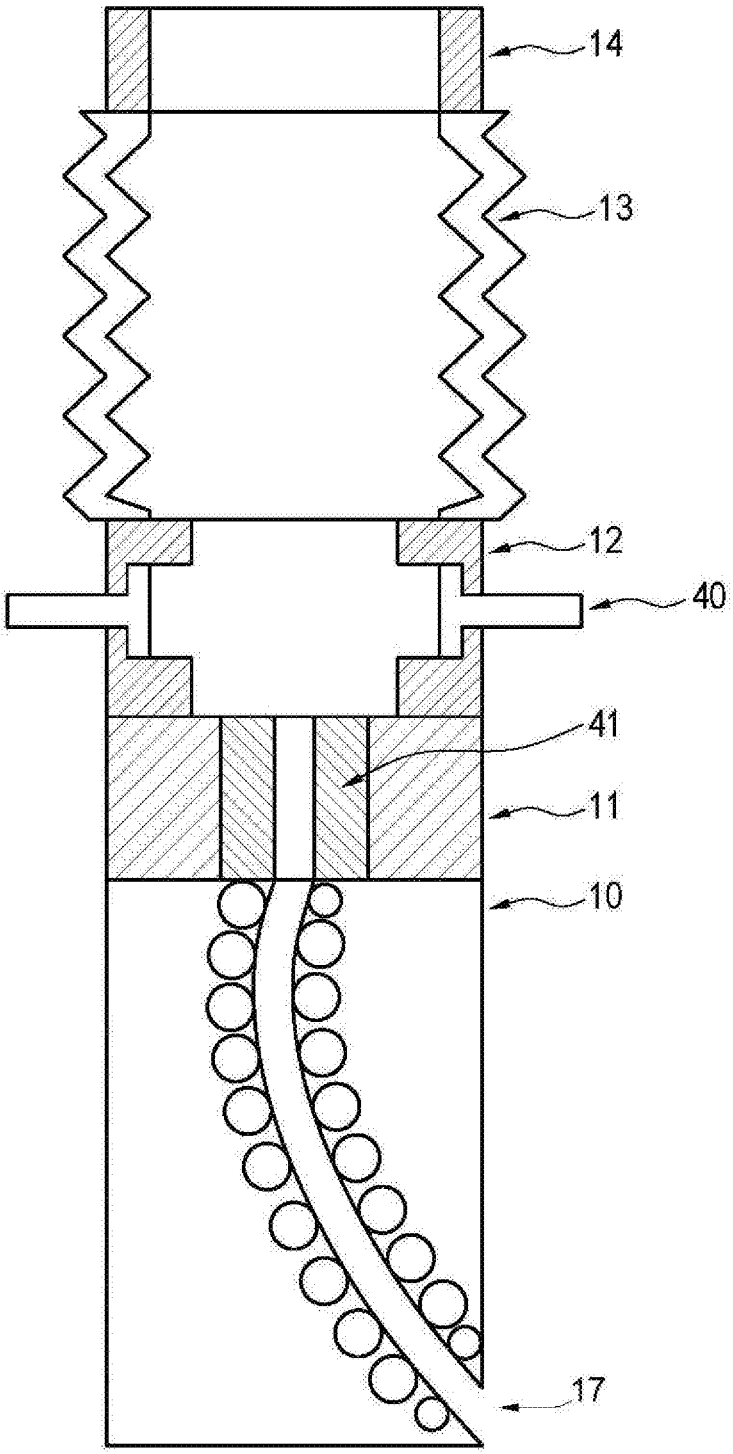
FIG. 5 is a schematic cut away view of the bottom hole assembly of the hydraulic drilling system shown in FIGS. 1 and 2, according to an embodiment of the present invention.

FIG. 1, FIG. 3 and FIG. 5 illustrate a hydraulic drilling system and method according to one embodiment of the present invention. FIG. 1 shows a hydraulic drilling system 120 that is usable for drilling boreholes in an existing wellbore 2 formed within in a geological surface 1. The existing wellbore 2 may be lined with casing 3. In FIG. 1, the system 120 is illustrated in connection with the drilling of a lateral borehole 27, which extends from the main wellbore 2 in the earth 5. Main wellbore 2 can be vertical, deviated or horizontal and may be the wellbore extending from surface or a lateral therefrom.

The system 120 has components that are for use above surface and others that are for use below surface. In the illustrated embodiment shown in FIG. 1, the system includes for example an upper section 102, which comprises a wellhead flange 4, a wellhead control equipment 6, a rotational device 7, a rotating flange 8, a hanger 15, a sealing element 16, and a movement control device 22. In the illustrated embodiment, all of the upper section components are placed above surface 1; however, in other embodiments, one or more of the upper section components may be placed below surface 1.

The wellhead control equipment 6 may be, for example, a blow out preventer. The rotational device 7 may be, for example, a tubing rotator. The hanger may be a flow tee having three openings all in fluid communication with one another. The sealing element 16 may be, for example, a pack-off head, a grease seal or a stripper packer. The movement control device 22 may be, for example, a winch, the rig draw works or an injector. The injector may be, for example, a coiled tubing or continuous rod injector.

In a sample embodiment, the components of the upper section 102 are connected one on top of another in the following sequence: wellhead flange 4, wellhead control equipment 6, rotational device 7, rotating flange 8, hanger 15, and sealing element 16, with the wellhead flange being the lowermost component (i.e. closest to the surface 1). Of course, the components of the upper section do not have to be connected in the exact order as described herein. Other configurations are possible.

Rotational device 7 is for rotating hanger 15 and seal assembly 16 through rotating flange 8. In a sample embodiment, as illustrated in FIG. 1, rotational device 7 is connected to wellhead control equipment 6, which is connected to wellbore flange 4, which is above casing 3. Rotating flange 8 has an upper flange and a lower flange that can rotate independently of one another. The upper end of rotational device 7 is connected to the lower flange of rotating flange 8. Hanger 15 is connected to the upper flange of rotating flange 8.

Each of the upper section components 4, 6, 7, 8, 15, and 16 has an inner bore such that when the upper section is assembled, the inner bores substantially align to form an inner bore that extends from wellhead flange 4 to an upper surface of sealing element 16.

Sealing element 16 includes an internal seal 28 and is attached to the upper surface of hanger 15. Hanger 15 has an inlet 25 that is in fluid communication with the inner bore of the hanger 15. Inlet 25 is connectable to a high pressure fluid source 24, to allow high pressure fluid to enter the inner bore via inlet 25.

Casing 3 has a proximate end and a distal end, with the proximate end being closer to the surface opening of wellbore 2. In the illustrated embodiment, the proximate end of casing 3 extends above surface 1 and is connected to wellhead flange 4.

In the illustrated embodiment shown in FIG. 1, the system includes a lower section 104, which comprises a tubular work string 14, connection string 21, a flow-through device 20, a drill tubing 19, and a bottom hole assembly 9. Bottom hole assembly 9 comprises a whipstock 10, a seal assembly 11, an anchor 12, and an extendable and contractible tubular work string 13.

The tubular work string 14 may comprise, for example, one or more of: casing, tubing, coiled tubing, and pipe. The connection string 21 may comprise, for example, one or more of cable, wireline, sucker rods, continuous rod, and coiled tubing. The anchor 12 may be, for example, a hydraulically activated anchor. The work string 13 may be, for example, an expansion joint.

Work string 14 has a proximate end, a distal end, and an inner bore extending therebetween. Work string 14 extends in the wellbore 2, with its proximate end passing through the inner bores of wellhead control equipment 6, rotational device 7, rotating flange 8 and being attached to hanger 15, by for example threaded connection. Work string 14 also engages the inner bore of rotational device 7. In a sample embodiment, as shown in FIG. 3, work string 14 has a plurality of work string splines 32 on its outer surface and the inner bore of rotational device has a plurality of rotational device splines 31 for engaging work string splines 32. Splines 31 and 32 are engageable with each other to transmit rotational movement from rotational device 7 to string 14. In one embodiment, splines 32 are substantially parallel to the long axis of string 14 lengthwise, and extend radially outwardly from the outer surface of string 14. Splines 31 extend radially inwardly from the inner surface of the rotational device towards the center of the inner bore thereof. Of course, other configurations of splines 31 and 32 are possible.

Rotational device 7 is held in place, through wellhead control equipment 6 and wellhead flange 4, by casing 3 which is secured to the ground adjacent wellbore 2. When rotational device 7 is activated, force is transmitted from rotational device splines 31 to work string splines 32, thereby rotating work string 14 and imparting rotational forces on hanger 15. Hanger 15 may rotate due to these rotational forces being transmitted though rotating flange 8. When rotational device 7 is activated, work string 14 rotates relative to wellbore 2 and casing 3. When rotational device 7 is inactivated, the engagement of rotational device splines 31 and work string splines 32 may prevent rotational movement of work string 14 during the placement of a borehole 27 using system 120, which will be described in more detail hereinbelow.

The outer surface of work string 14 and the inner wall of casing 3 define an outer annulus 42. In one embodiment, for example as illustrated in FIGS. 1 and 3, casing 3 includes an outlet 29 near its proximate end. The flow of fluid through outlet 29 is controlled by an outlet valve 30. When valve 30 is open, outlet 29 allows fluid communication between annulus 42 and the space above surface 1 outside system 120. When valve 30 is closed, fluid flow through outlet 29 is restricted.

The distal end of work string 14 is connected to extendable work string 13, which in turn is connected to anchor 12. Seal assembly 11 connects anchor 12 to whipstock 10. Each of extendable work string 13, anchor 12, and seal assembly 11 has an inner bore such that when bottom hole assembly 9 is assembled, the inner bores are substantially aligned to form an inner bore that extends between the proximate end of extendable work string 13 and the distal end of seal assembly 11. Whipstock 10 has an upper opening and a lower opening 17 (the latter also referred to as a "whipstock exit"), with a curved inner bore extending therebetween, to allow the movement of the drill tubing 19 therethrough. When rotational device 7 is activated, the rotation of string 14 causes whipstock 10 to rotate, which allows the radial direction of the whipstock exit to be changed.

Anchor 12 has a retracted position and an expanded position, the latter for engaging the inner surface of casing 3. The effective outer diameter of anchor 12 is smaller in the retracted position than in the expanded position, such that anchor 12 can be run into the wellbore 2 in the retracted position without engaging the casing 3.

In one embodiment, anchor 12 is activated from the retracted position to the expanded position by an increase in fluid pressure in its inner bore. For example, in the illustrated embodiment shown in FIG. 5, anchor 12 includes anchor pistons 40, with the piston heads inside anchor 12, in communication with the inner bore thereof, and the piston bodies being extendable radially outwardly beyond the outer surface of anchor 12 while the piston heads are maintained inside anchor 12. Pistons 40 are positioned in anchor 12 such that when the fluid pressure inside anchor 12 increases, the increase in pressure pushes the piston heads radially outwardly inside anchor 12, thereby extending the piston bodies radially outwardly beyond the outer surface of anchor 12 to increase the effective outer diameter of same, thus placing the anchor in the expanded position. The length of the piston bodies of pistons 40 are selected to be able to frictionally engage the inner wall of casing 3 when the pistons 40 are extended (i.e. when anchor 12 is in the expanded position). Of course, other anchoring mechanisms may be employed for system 120.

Extendable work string 13 is extendable and contractible in the axial direction. As an example, extendable work string 13 may be an expansion joint. In a further example, extendable work string 13 may be made of two substantially concentric telescoping tubes: an outer tube having a larger diameter than the inner tube. The inner and outer tubes have a sealing surface within the annulus formed between the inner surface of the outer tube and the outer surface of the inner tube, thereby creating a sealed bore within the tubes for the passage of fluids therein.

Each tube is slideably movable in the axial direction relative to the other tube. In one embodiment, each tube has a first end and a second end, and when extendable work string 13 is in a minimum length position (i.e. when string 13 is in most contracted), the first end of the inner tube is near the first end of the outer tube. When string 13 is in a maximum length position (i.e. when string 13 is most expanded), the first end of the inner tube is near the second end of the outer tube. In a further embodiment, the first end of the outer tube is threaded and the second end of the inner tube is threaded. In an alternative embodiment, the second end of the outer tube is threaded and the first end of the inner tube is threaded. The threading of the tubes allows the extendable work string to be threadedly connected to the distal end, within or at the proximate end of working string 14 and anchor 12. The sealing surface between the tubes is configured such that it is maintained when the string 13 is minimum and maximum length positions, and anywhere in between.

String 13 may be configured such that it is free to extend and contract in the axial direction of work string 14. Preferably, work string 13 is connected to work string 14 such that their central long axes are substantially parallel or align with one another. For example, work string 13 may be integrated with work string 14 to form a length thereof. Alternatively, string 13 may have friction and/or spring type devices to restrict or counteract axial movement thereof. In a preferred embodiment, the work string 13 is positioned near the whipstock.

The drill tubing 19 has a proximate end and a distal end. The distal end includes a drill head 18. The drill tubing 19, drill head 18, and the flow through device 20 (if included), collectively, are referred to herein as the drill assembly. In one embodiment, drill head 18 is capable of rotation and handling abrasives. An inner bore passes through the drill tubing and is open at the drill head 18. The drill head can be of any suitable design, and in one embodiment, it includes a nozzle that opens from its inner bore to its outer surface and acts to produce a cutting jet from drilling fluid passing therethrough that is capable of breaking down formation materials. In addition to producing the cutting jet, the drilling fluid exerts a force on the drill head 18 which drives the drill tubing 19 and the drill head 18 in the forward direction to form borehole 27.

Drill tubing 19 is extended inside work string 14 and is movable axially within the work string. For use to drill a borehole 27, drill tubing 19 is inserted through the inner bores of work string 14, extendable work string 13, anchor 12, seal assembly 11, and whipstock 10, with the distal end of drill tubing 19 extending into the inner bore of whipstock 10. The curvature of the whipstock inner bore acts to bend drill tubing 19 advancing through the whipstock and to direct the tubing outwardly from the long axis of the work string 14. In one embodiment, as shown for example in FIG. 5, rollers may be provided in the inner bore of whipstock 10 to aid the passage of the drill tubing 19 therethrough. By advancement of the drill tubing 19 through the whipstock 10, the distal end of the drill tubing may be directed away from the main wellbore 2 to form lateral borehole 27. A seal 41 is provided in seal assembly 11 to control and/or substantially prevent fluid flow through the interface between the drill tubing and the whipstock inner bore.

The connection string 21 extends inside work string 14, and has a proximate end and a distal end. The flow-through device 20 connects the distal end of connection string 21 to the proximate end of the drill tubing 19, inside the work string 14. The connection string 21 passes through the inner bores of the upper section components. The proximate end of connection string 21 extends beyond the upper surface of the sealing element 16 and connects to the movement control device 22.

The flow-through device 20 includes at least one conduit 26 opening at a first end on the outer surface of the flow-through device and extending to open at a second end into the inner bore of drill tubing 19. Conduit 26 allows fluid communication between the outer surface of flow-through device 20 and the inner bore of drill tubing 19 through to drill head 18.

Flow-through device 20 and drill tubing 19 are moveable axially inside the work string by movement of the connection string 21. Drill tubing 19 and connection string 21 may comprise one or more of the following: cable, wireline, a string of rods, such as sucker rods (including standard form sucker rods, polish rods, etc.), continuous rod, continuous coiled tubing, etc. The term "continuous" herein refers to a length of connection string that is unbroken along its length that is passed down the main wellbore 2, as opposed to a connection string formed of a plurality of rods connected end to end. Connection string 21 is advanced axially into the work string by movement control device 22. Movement control device 22 applies tensile forces and/or compressive forces to connection string 21 to help control axial advancement and/or retraction of connection string 21, flow through device 20, drill tubing 19 and drill head 18. Movement control device 22 may be for example, a winch, the rig draw works, or an injector.

Sealing element 16 in the upper section provides a seal between the work string 14 and the connection string 21 such that a sealed inner annulus 23 is formed between the outer surface of the connection string/flow-through device/drill tubing and the inner surface of the work string 14. As noted hereinbefore, inner annulus 23 is sealed at its lower end by seal assembly 11. Seal assembly 11 is configured to seal against the outer diameter of drill tubing 19 to maintain fluid pressure containment in the annulus 23 while allowing the tubing 19 to move forward through the seal 41.

A method according to one aspect of the present invention includes: running a work string 14 into an existing vertical, deviated or horizontal wellbore 2. A bottom hole assembly 9 is provided at the distal end of the work string 14. The bottom hole assembly 9 includes a whipstock that directs the drill head 18 of system 120, for example in a radial direction from the long axis of the existing wellbore 2.

More specifically, the method comprises lowering the distal end of work string 14 into wellbore 2 through the inner bores of rotating flange 8, rotational device 7 and wellhead control system 6. The method further comprises connecting the proximate end of the drill tubing 19 to the distal end of the connection string 21 using the flow-through device 20, and then lowering the drill tubing, the flow-through device, and the connection string through the inner bore of hanger 15 and then into work string 14. The proximate end of the work string 14 is connected to hanger 15.

The drill tubing 19, along with the drill head 18 attached to the distal end of thereof, and flow-through device 20 attached to the proximate end of the drill tubing 19 are run into wellbore 2 axially by extending the length of the connection string 21 inside the work string 14 using the movement control device 22. As more length of the connection string 21 is extended into the work string, the more the drill tubing advances into the wellbore 2. The connection string 21 is advanced axially inside the work string by movement control device 22 until drill head 18 reaches seal assembly 11 and is sealingly engaged therewith.

Once the drill head 18 enters the sealing assembly 11, sealing element 16 is incorporated above surface such that seal 28 sealingly engages the outer surface of the connection string to fluidly seal the space above the sealing element from the space below. Inlet 25 of hanger 15 is connected to a high pressure fluid source 24. High pressure fluid is then injected into inner annulus 23, via inlet 25. This high pressure fluid is pumped down annulus 23 and enters the drill tubing 19 via conduit 26 of flow-through device 20.

Once inside the drill tubing 19, the fluid flows to the drill head 18 whereby the fluid pressure generates a downward force on the drill tubing. The fluid also exits the drill head 18 as a high-pressure cutting jet which is directed at the formation that is to be cut away to create a lateral bore 27. Depending on where borehole 27 is to be drilled into earth 5, casing 3 may or may not cover the part of the inner wall of wellbore 2 where borehole 27 is to be drilled. If casing 3 covers the part of the inner wellbore wall where borehole 27 is to be drilled, casing 3 is removed, milled or perforated prior to the placement of borehole 27. A method for perforating casing is described hereinbelow.

The increase in fluid pressure in annulus 23 activates anchor 12 to the expanded position, thereby keeping bottom hole assembly 9 in place during drilling operations. Any axial movement in work string 14 caused by pressure fluctuations can be compensated for by extendable work string 13. The fluid cutting jet formed at drill head 18 penetrates earth 5 to create borehole 27. The hydraulic forces created inside drill head 18 drives the drill tubing 19 forward and movement control device 22 controls the forward movement of the drill tubing 19 via the connection string 21. In one embodiment, outlet valve 30 is opened to allow fluid returning from borehole 27 to flow up the wellbore through outer annulus 42 and exit at outlet 29 to surface facilities (not shown).

When the drilling of borehole 27 is completed, the drill tubing is retracted through the upward movement of the connection string until the drill head 18 is retracted through the whipstock to above seal assembly 11. If desired, whipstock 10 can be re-oriented by rotating work string 14, via the rotation of hanger 15 using rotational device 7. Once whipstock 10 is re-oriented, drill head 18 may once again be lowered and engaged in seal assembly 11 and another borehole (not shown) may be drilled. This process may be repeated as many times as desired.

In a further embodiment, system 120 may be used for downhole fracture stimulation. As mentioned above, during drilling operations, at least some of the drilling fluid exiting drill head 18 flows upwards in outer annulus 42 towards surface, and may be collected through valve 30. However, keeping valve 30 closed or pressure-controlled causes the pressure in outer annulus 42 to increase, thereby increasing the fluid pressure in borehole 27. When the fluid pressure in borehole 27 increases to exceed the fracture pressure of the earth 5 in borehole 27, the earth fractures and a fracture is generated at the borehole. The pressure in annulus 42 may be modulated by controlling the opening and closing of valve 30 as drill head 18 extends into borehole 27, thus it may be possible to initiate fractures in multiple locations along borehole 27. Therefore, the system allows the initiation of fractures at one or more desired locations, at a distance from the wellbore.

In another embodiment, a portion of outer annulus 42 may be fluid sealed by placing a packer system (not shown) comprising at least one packer in annulus 42, and engaging the packer system when desired, to stop the flow of fluid back to the surface. Once the packer system is engaged to prevent fluid in annulus 42 to exit at surface, the pressure in annulus 42 below the packer system increases, thereby increasing the fluid pressure in borehole 27. When the fluid pressure in borehole 27 increases to exceed the fracture pressure of the earth 5 in borehole 27, the earth fractures and a fracture is generated at the borehole.

In one embodiment, the packer system in communication with the fluid pressure inside work string 14 such that the packer system is engaged when the pressure within work string 14 exceeds an engagement threshold pressure and is disengaged when the pressure within work string 14 is below a disengagement threshold pressure, which may or may not be the same as the engagement pressure. The packer system may be installed in work string 14. In an alternative or additional embodiment, the packer system may be engaged and/or disengaged by the exertion of axial forces on work string 14 from surface. The axial forces are opposed by anchor 12 thus resulting in the engagement and/or disengagement of the packer system. Whether modulating the pressure within string 14 and/or applying axial forces on string 14, the packer system may be engaged and disengaged more than once during the placement of borehole 27, thereby allowing the initiation of fractures in multiple locations along borehole 27.

In yet another embodiment, a packer system (not shown) is placed directly into the borehole as part of the drill tubing 19, above drill head 18. When the borehole is drilled to a prescribed length, the packer system is engaged while the flow of drilling fluid continues. Once the packer system is engaged, the pressure in the borehole increases from the drilling fluid buildup. When the fluid pressure in borehole 27 increases to exceed the fracture pressure of the earth 5 in borehole 27, the earth fractures and a fracture is generated at the borehole. This process may take place one or more times during the placement of borehole 27.

In one embodiment, the packer system in communication with the fluid pressure inside drill tubing 19 such that the packer system is engaged when the pressure within drill tubing 19 exceeds an engagement threshold pressure and is disengaged when the pressure within drill tubing 19 is below a disengagement threshold pressure, which may or may not be the same as the engagement pressure. By modulating the pressure within tubing 19, the packer system may be engaged and disengaged more than once during the placement of borehole 27, thereby allowing the initiation of fractures in multiple locations along borehole 27.

Figure 18:
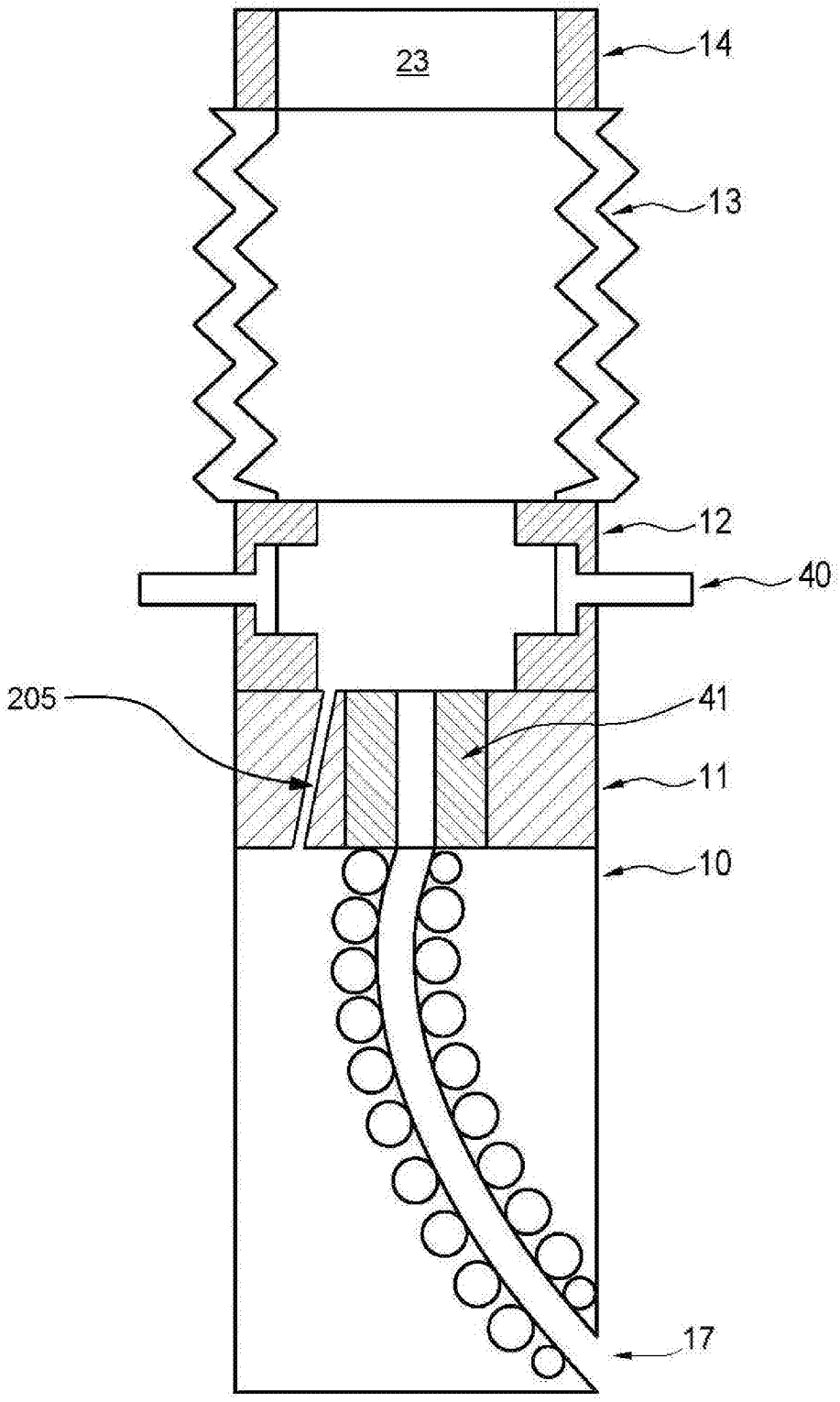
FIG. 18 is a schematic cut away view of the bottom hole assembly according to another embodiment of the present invention.

In a further embodiment, as illustrated in FIG. 18, a passage 205 may be provided in the down hole assembly to allow some fluid from annulus 23 to bypass lower seal assembly 11. Allowing some fluid to bypass the seal assembly 11 may be helpful in providing additional circulation fluids and/or a cooling source for electronics in elevated temperature wells. Preferably, the effective inner diameter of the passage 205 is selected to allow fluid flow therethrough without substantially reducing the fluid pressure inside annulus 23.

A method for heating or cooling the earth near the borehole comprises positioning the drill head at or near the distal end of the borehole; supplying a fluid into the drill tubing and discharging the fluid through the opening at the distal end of the drill tubing, the fluid having a temperature different from an initial temperature of earth surrounding the distal end of the borehole, thereby changing the initial temperature to a new temperature; and ceasing the supply of the fluid in the drill tubing to allow the earth to return to the initial temperature. The method may further comprise changing the initial temperature to the new temperature causes a phase change of at least one liquid in the earth near the distal end of the borehole. Still further, the method may comprise generating or augmenting fractures in the surrounding earth by supplying a pressurized fluid into the drill tubing and injecting the pressurized fluid into the borehole through the opening of the drill tubing. The fluids that may be used with the method include for example: liquid or gaseous carbon dioxide, liquid or gaseous nitrogen, steam.

The method may further comprise injecting a flow manipulation fluid through the drill tubing and into the borehole via the opening of the drill tubing. The flow manipulation fluid may include for example one or more of: steam, carbon dioxide, nitrogen, surfactant, lubricant, solvent, retardant, resin, polymer, gel, and cement.

In another embodiment, the borehole's surrounding earth may be heated by an earth manipulation device that can be selectively activated to generate heat, which may include for example, a resistive heating element, a microwave generating device, an antenna, etc. For example, the resistive heating element may be installed on the drill tubing or may be integrated with the drill tubing itself.

Figure 19A:
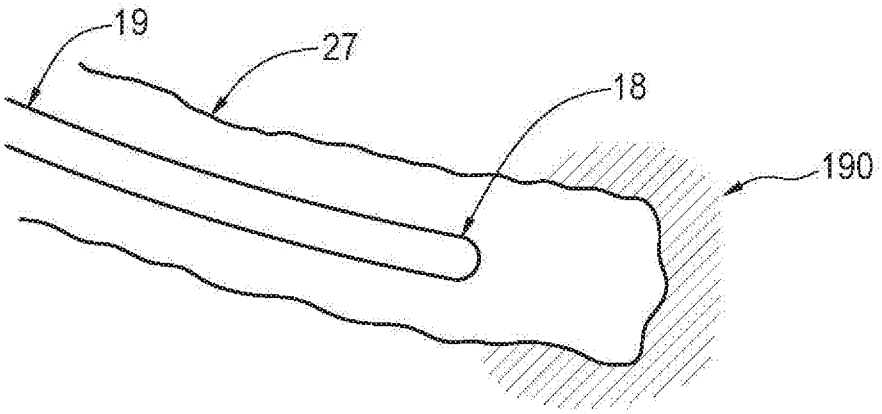
FIGS. 19*a*, 19*b*, and 19*c* are schematic elevation views of a freeze fracture stimulation using a hydraulic drilling system and method in accordance with another embodiment of the present invention.
Figure 19B:
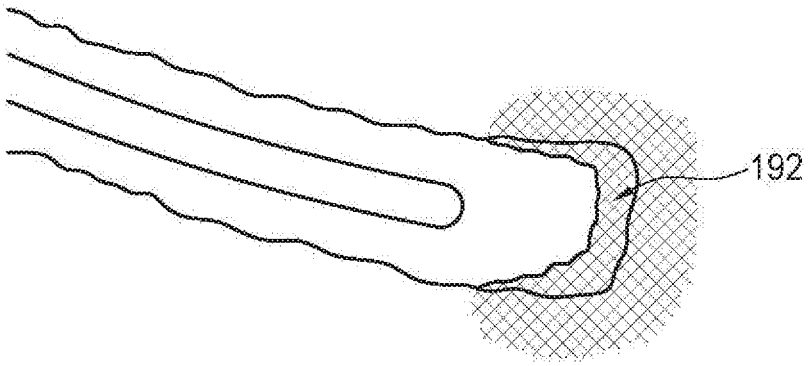
Figure 19C:
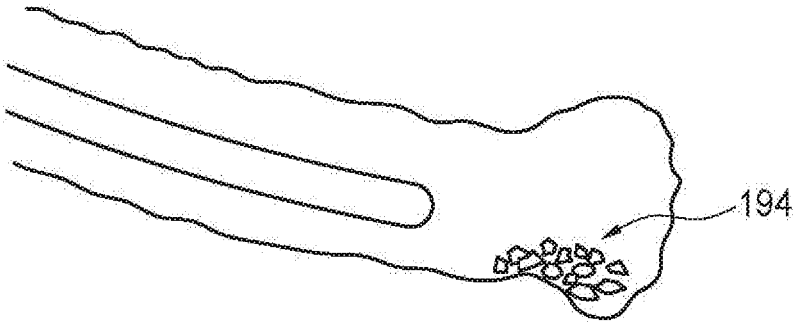

For example, a method for freeze fracture stimulation can be performed for borehole 27. With reference to FIGS. 19*a* to 19*c*, the method comprises injecting a cooling fluid into the borehole 27 to cool the borehole and the nearby earth 190. The cooling fluid may be for example: (i) a gas, such as carbon dioxide or nitrogen; or (ii) a liquid that becomes a gas under reservoir conditions, such as liquid carbon dioxide or liquid nitrogen. The cooling fluid is injected into drill tubing 19 and exits drill head 18, while inside borehole 27. When it exits the drill head, the cooling fluid expands into a gas and the resulting Joule-Thompson effect causes the cooling of any existing fluid in the borehole and the surrounding earth 190.

Referring to FIG. 19*b*, if the surrounding earth 190 contains water, the temperature of the water may be reduced below its freezing temperature and becomes ice 192 as a result of the cooling effect. Since ice has a higher volume than liquid water, the ice 192 creates stresses within the earth 190. If these stresses are above the fracture stresses of the earth, then fracture stimulation occurs in the borehole.

Referring to FIG. 19*c*, when the flow of cooling fluid into the borehole ceases, the temperature in the borehole rises and ice 192 melts, which then causes fractured material 194 from earth 190 to fall to a lower inner surface of the borehole. The fracture material 194 may be cleaned out by circulating drilling fluid through drill head 18 and into the borehole, so that fracture material 194 can flow up outer annulus 42 with the drilling fluid.

The above described method may further comprise injecting a flow manipulation fluid through the drill tubing and into the borehole via the opening of the drill tubing. The flow manipulation fluid may include for example one or more of: steam, carbon dioxide, nitrogen, surfactant, lubricant, solvent, retardant, resin, polymer, gel, and cement.

The method may further comprise injecting a flow manipulation fluid through the drill tubing and into the borehole via the opening of the drill tubing to manipulate the permeability of the earth, and the flow manipulation fluid is one or more of: a retardant, resin, polymer, gel, and cement.

The borehole may be near a reservoir containing a reservoir fluid with a viscosity, and the method may further comprise injecting a flow manipulation fluid through the drill tubing and into the borehole via the opening of the drill tubing to manipulate the viscosity of the reservoir fluid, and the flow manipulation fluid is one or more of: steam, carbon dioxide, nitrogen, lubricant and solvent.

The method may further comprise injecting a surfactant through the drill tubing and into the borehole via the opening of the drill tubing to manipulate the rock wettability of the earth.

In another embodiment, the borehole's surrounding earth may be heated by an earth manipulation device that can be selectively activated to generate heat, which may include for example, a resistive heating element, a microwave generating device, an antenna, etc. For example, the resistive heating element may be installed on the drill tubing or may be integrated with the drill tubing itself.

Figure 2:
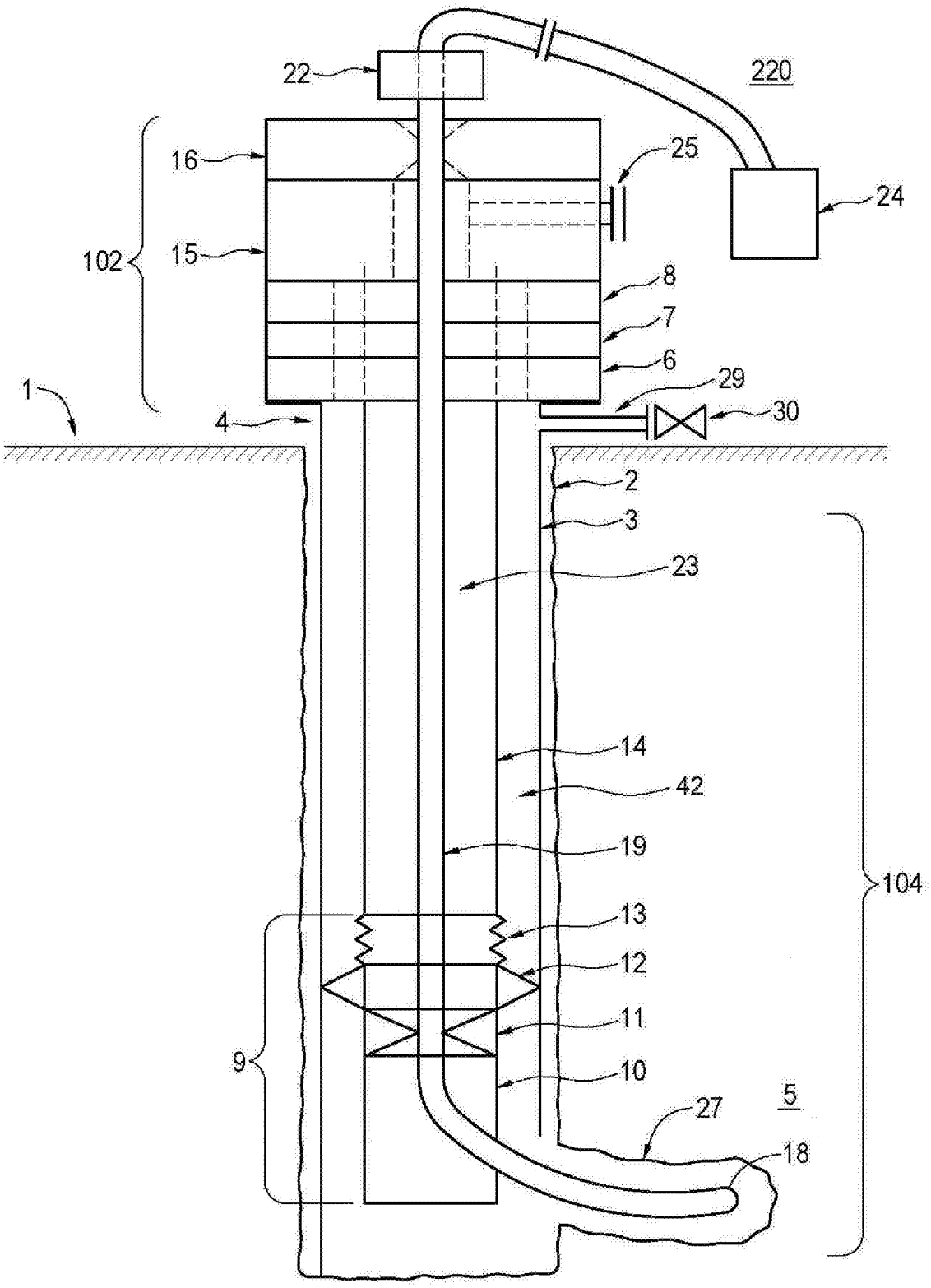
FIG. 2 is an elevation schematic view the hydraulic drilling system according to another embodiment of the present invention.

FIG. 2, FIG. 3 and FIG. 5 illustrate another embodiment of the hydraulic drilling system and method of the present invention. In this embodiment, the components of the system 220 are the same as those shown in the embodiment illustrated in FIG. 1, except that the connection string and flow through device are omitted. In this embodiment, a drill tubing 19' is used. Drill tubing 19' has a proximate end and a distal end. In one embodiment, the proximate end of the drill tubing 19' is above the ground surface of the wellbore opening and a portion of the tubing 19' is contained on a spool at surface. As tubing 19' is advanced into the wellbore, the tubing is unrolled from the spool.

The proximate end is fluidly connectable to high pressure fluid source 24. The distal end includes a drill head 18. Drill tubing 19' is extendable through movement control device 22, through the inner bores of all the components of the upper section 102, down work string 14, and through the bottom hole assembly 9. When drill tubing 19' is extended inside work string 14, an inner annulus 23' is formed between the outer surface of the drill tubing 19' and the inner surface of work string 14.

A method for drilling a borehole 27 in wellbore 2 using system 220 comprises lowering the distal end of work string 14, with bottom hole assembly 9 attached, into wellbore 2 through the inner bores of rotating flange 8, rotational device 7 and wellhead control system 6 and connecting the proximate end of work string 14 to hanger 15 which is then attached to the top of rotating flange 8. The method further comprises connecting the proximate end of the drill tubing 19' to the high pressure fluid source 24, and then placing the drill tubing 19' through the movement control device 22 such that movement control device engages a portion of the drill tubing 19'. Further, the method comprises lowering the drill tubing 19' through the inner bores of sealing element 16 and hanger 15, and then into work string 14. Sealing element 16 is then incorporated that seal 28 sealingly engages the outer surface of drill tubing 19' to fluidly seal the space above the sealing element from the space below.

The drill tubing 19', along with the drill head 18 attached to the distal end of thereof, is advanced axially into wellbore 2 using the movement control device 22. The drill tubing 19' is advanced axially inside the work string by movement control device 22 until drill head 18 reaches seal assembly 11 and is sealingly engaged therewith.

High pressure fluid is then injected into drill tubing 19' from the high pressure fluid source. Once inside the drill tubing 19', the fluid flows to the drill head 18 whereby the fluid pressure generates a downward force on the drill tubing. The fluid also exits the drill head 18 as a high-pressure cutting jet which is directed at the formation that is to be cut away to create a lateral bore 27.

Optionally, high pressure fluid may be injected into inner annulus 23 via inlet 25 to activate anchor 12 in order to hold bottom hole assembly 9 in place during operations.

Any axial movement in work string 14 caused by pressure fluctuations can be compensated for by extendable work string 13. The fluid cutting jet formed at drill head 18 penetrates earth 5 to create borehole 27. The hydraulic forces created inside drill head 18 drives the drill tubing 19' forward and movement control device 22 controls the forward movement of the drill tubing 19'. In one embodiment, outlet valve 30 is opened to allow fluid returning from borehole 27 to flow up the wellbore through outer annulus 42 and exit at outlet 29 to surface facilities (not shown).

When the drilling of borehole 27 is completed, the drill tubing 19' is retracted through by the movement control device 22 until the drill head 18 is retracted through the whipstock to above seal assembly 11. If desired, whipstock 10 can be re-oriented by rotating work string 14, via the rotation of hanger 15 using rotational device 7. Once whipstock 10 is re-oriented, drill head 18 may once again be lowered and engaged in seal assembly 11 and another borehole (not shown) may be drilled. This process may be repeated as many times as desired.

In one embodiment, system 220 may be used for fracture stimulation and freeze fracture stimulation in the same ways as described above with respect to system 120.

Figure 6:
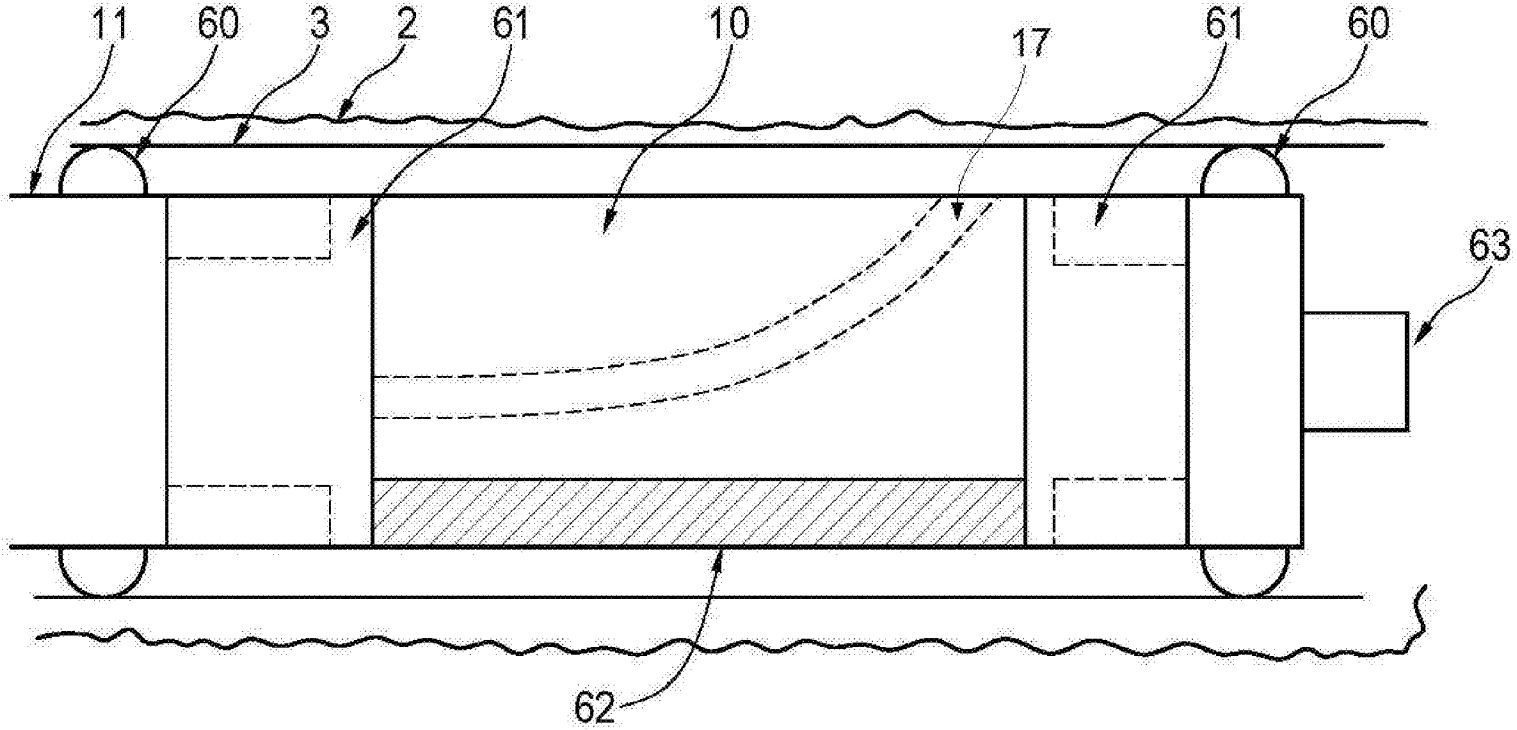
FIG. 6 is a schematic view of the bottom hole assembly of the hydraulic drilling system shown in FIGS. 1 and 2, according to another embodiment of the present invention.

FIG. 6 illustrates a sample bottom hole assembly that is usable with the above described systems. More specifically, the bottom hole assembly shown in FIG. 6 can be used for circumferentially aligning same. FIG. 6 only shows the components of the bottom hole assembly below anchor 12. In the illustrated embodiment, bottom hole assembly 9 includes centralizers 60 on its outer surface to keep the outer surface of the whipstock from coming into contact with the inner wall of the wellbore or casing. Preferably, the centralizers 60 are installed axially above and below the whipstock. Further, whipstock 10 is mounted between two swivels 61. Preferably, each end of the swivel 61 can rotate independently of the other end. The swivels 61 give whipstock 10 the freedom to rotate about the central long axis of the bottom hole assembly relative to the other components of the assembly.

In one embodiment, a weight 62 is placed on whipstock 10 for aligning the whipstock exit 17 to a desired exit direction. Weight 62 increases the mass of whipstock 10 in an eccentric manner causing the whipstock exit to be biased in a particular direction by the force of gravity, as the weight 62 tends to lie on the bottom (as determined by gravity). In the illustrated embodiment in FIG. 6, weight 62 is disposed on the side of the whipstock that is substantially directly opposite to the whipstock exit, to direct the whipstock exit in a substantially vertical direction (as determined by gravity) when the bottom hole assembly is in a substantially horizontal wellbore. By placing weight 62 on different parts of the whipstock, various orientations of the whipstock exit direction may be achieved.

In a further embodiment, the bottom hole assembly includes a drive mechanism 63 for rotating whipstock 10 between swivels 61 about the central long axis of the bottom hole assembly. Drive mechanism 63 may be for example an electric motor, which may be for example powered by batteries or another electrical power storage device (not shown) or stored mechanical energy powered by spring energy (not shown).

In one embodiment, it may be possible to recharge either power source for the drive mechanism from energy derived from the hydraulic energy of fluid flowing through work string 14. Hydraulic energy can be derived from fluid flow, for example, by using a water wheel or a turbine and this hydraulic energy can be changed to a number of different forms of energy including electrical and mechanical energy. In one embodiment, with reference to FIGS. 1, 2 and 6, when nozzle 18 is above seal assembly 11, fluid flow is directed across a rotating device (not shown), which may be a turbine or a water wheel, that is connected to a generator (not shown) which in turn is connected to the drive mechanism 63. The rotation of the rotating device caused by fluid flow thereacross turns the generator, thereby electrically charging the drive mechanism 63.

In a further embodiment, when nozzle 18 is above seal assembly 11, fluid flow is directed across a rotating device (not shown) which is connected through a gearing mechanism (not shown) to springs (not shown) that drive the stored mechanical energy. The rotation of the rotating device caused by fluid flow thereacross turns the gearing mechanism, thereby exerting a force on the springs which can be selectively released subsequently as stored mechanical energy.

In a still further embodiment, when nozzle 18 is above seal assembly 11, fluid flow is directed through an electrical coil (not shown) which is connected to the drive mechanism 63. If the fluid or particles in the fluid flow have electrical or magnetic qualities, an electric current is generated by the electrical coil, thereby electrically charging drive mechanism 63.

Bottom hole assembly 9 may include one or both of weight 62 and drive mechanism 63.

If a drive mechanism is used for bottom hole assembly 9, the drive mechanism may be controlled from surface using radio signals, mud pulse signals, pressure signals, acoustical signals, or a combination thereof. In a further embodiment, the drive mechanism may be controlled by a preprogrammed down hole processor.

Figure 7:
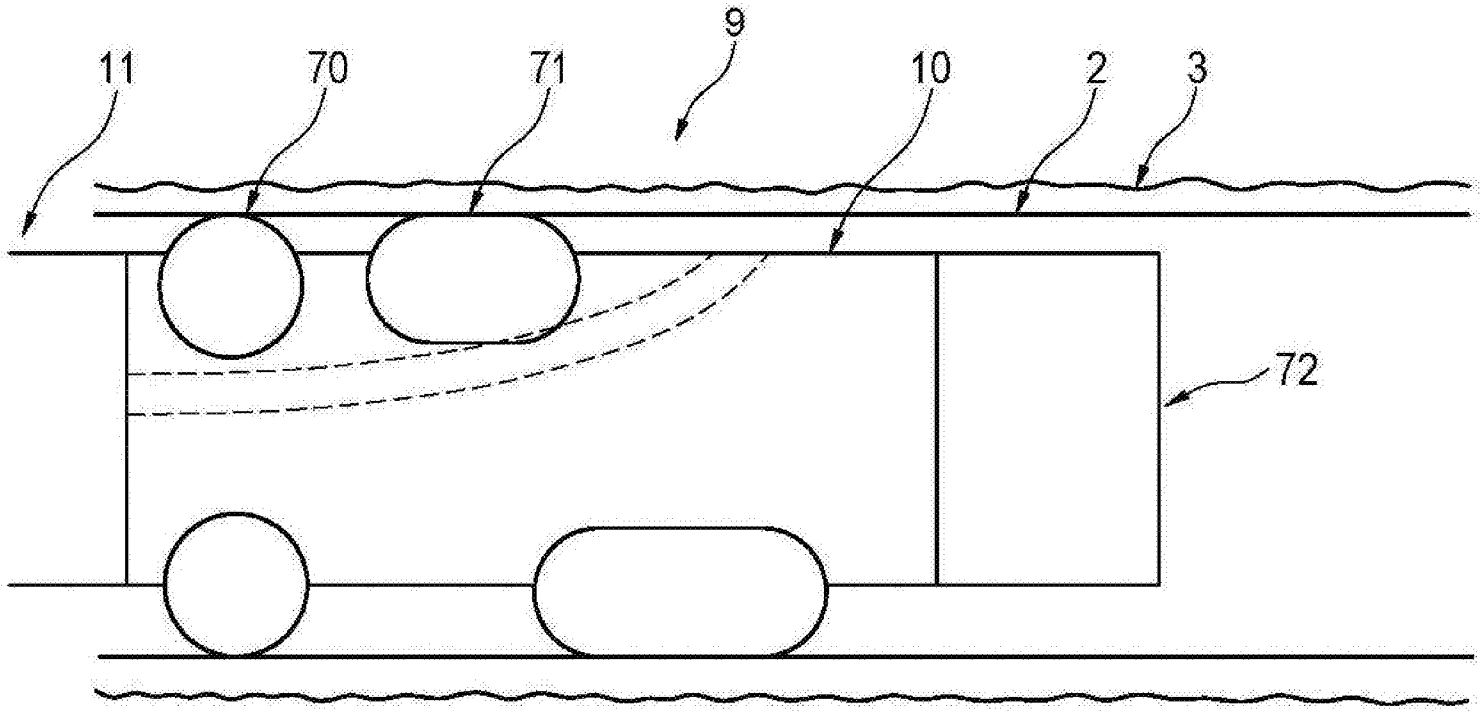
FIG. 7 is a schematic view of the bottom hole assembly of the hydraulic drilling system shown in FIGS. 1 and 2, according to yet another embodiment of the present invention.

FIG. 7 shows a sample bottom hole assembly that is usable with the above described systems. More specifically, the bottom hole assembly shown in FIG. 7 can be used to axially align same. FIG. 7 only shows the components of the bottom hole assembly below anchor 12. In the illustrated embodiment shown in FIG. 7, the bottom hole assembly has energy transfer devices installed on its outer surface. The energy transfer devices may be, for example, wheels 70, treads 71, inchworm mechanisms (not shown), or a combination thereof.

In one embodiment, the energy transfer devices are spring loaded and aligned axially and circumferentially so that they constantly push against the inner wall of wellbore 2 or casing 3 to keep the whipstock from contacting the inner wall of the wellbore or casing. The energy transfer devices may be used with swivels 61 (FIG. 6) and may be configured such that the whipstock can be rotated about its central long axis by use of swivels 61 without moving the energy transfer devices. More specifically, the energy transfer devices may be situated closer to the wellbore opening at surface than an upper swivel and further from the wellbore opening than a lower swivel, such that the swivels are positioned between the energy transfer devices.

In one embodiment, the bottom hole assembly includes a drive mechanism 72 to supply power to wheels 70 or treads 71 to drive the movement of wheels 70 or treads 71. The movement of wheels 70 or treads 71 in turn causes the whipstock to move in the direction of its long central axis, thereby allowing the relocation of the whipstock axially in casing 3 or wellbore 2. If extendible and contractible work string 13 is also included, it is then possible to move bottom hole assembly 9 axially relative to the wellbore without adjusting work string 14 at surface. Drive mechanism 72 may be for example an electric motor, which may be for example powered by batteries or another electrical power storage device (not shown) or stored mechanical energy powered by spring energy (not shown). Drive mechanism 72 may be recharged and/or controlled in ways as described with respect to drive mechanism 63.

Figure 8:
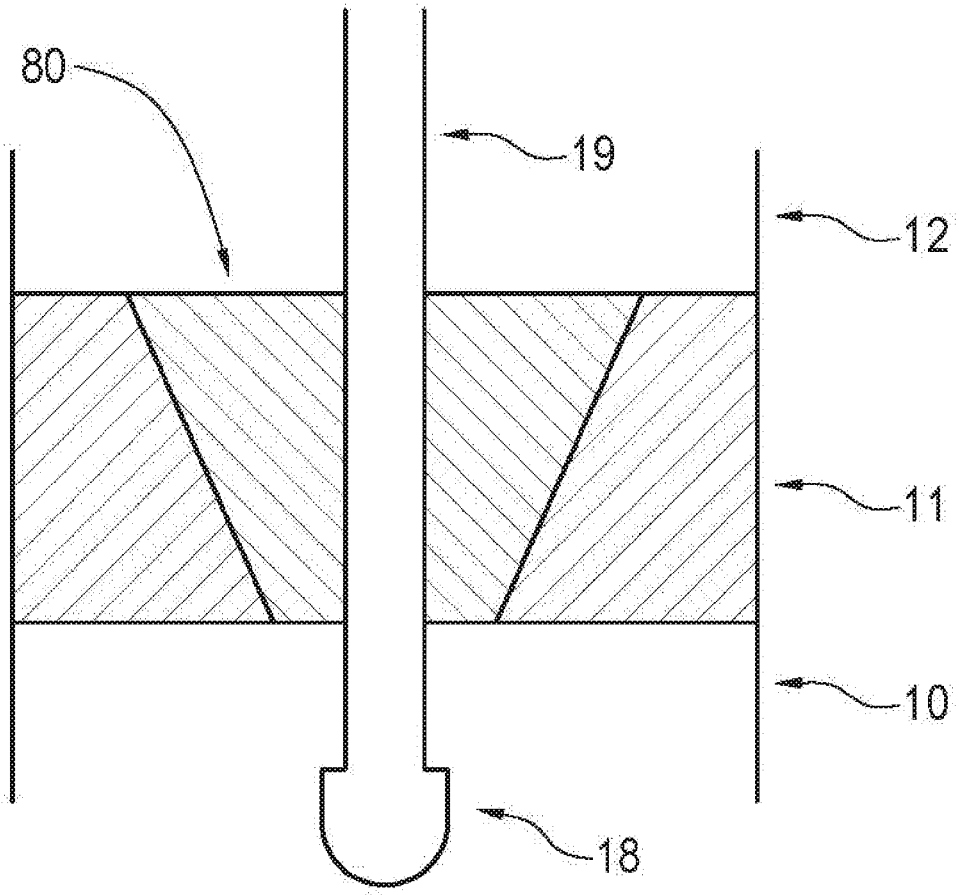
FIG. 8 is a schematic view of a seal assembly usable with the hydraulic drilling system shown in FIGS. 1 and 2, according to one embodiment of the present invention.

FIG. 8 illustrates a sample seal assembly configuration usable with the above described systems. Seal assembly 11 includes a seal 80, which may be replaced at surface without having to retract the work string 14 from the wellbore. Seal assembly 11 has an inner bore for receiving seal 80. Seal 80 has an outer surface and an inner axial bore, the latter providing a passage for drill tubing 19.

In this embodiment, the drill head 18 of drill tubing 19 has an outer diameter that is greater than the diameter of the inner bore of seal 80. Further, the outer surface of seal 80 and the inner bore of seal assembly 11 are shaped such that they mate with and frictionally engage each other, and seal 80 is prevented from moving all the way through the inner bore past the lower end of the seal assembly 11, when seal 80 is received inside seal assembly 11. For example, as shown in the illustrated embodiment, the inner bore of seal assembly 11 and the outer surface of seal 80 are both generally frustoconically shaped, i.e. the effective outer diameter gradually reduces from an upper end to a lower end. Since the outer diameter of the upper end of seal 80 is greater than that of the lower end of seal assembly 11, the inner bore of seal assembly 11 forms a seat for receiving seal 80, and seal 80 is prevented from going through the seal assembly. Preferably, seal 80 can only be removed from seal assembly 11 by an upward force without substantial deformation of the seal.

To set up the seal assembly for drilling operations, seal 80 is placed on the drill tubing, with the drill tubing slidably movable in the inner bore of the seal 80, and the drill head 18 is connected to the distal end of the drill tubing, below seal 80. The drill tubing, along with seal 80 and drill head 18, is run into the wellbore inside work string 14. When seal 80 reaches seal assembly 11, seal 80 is received in the seat of seal assembly 11 and frictionally engages same while the drill tubing continues to advance down the work string. The engagement between seal assembly 11 and seal 80 forms a fluid seal to prevent substantially all fluid flow through seal assembly 11, except via the inside of drill tubing 19.

To replace seal 80, the drill tubing 19 is pulled upwards inside the work string and sealingly passes through seal 80. When drill head 18 reaches and abuts against seal 80, drill head 18 is prevented from passing through seal 80 since the outer diameter of drill head 18 is larger than the diameter of the inner bore of the seal 80. As the drill tubing 19 continues to retract from the work string, the drill head 18 exerts an upward force on the lower face of seal 80, until the force is sufficient to disengage and unseat seal 80 from seal assembly 11. The unseated seal 80 then moves upwards with the drill tubing to surface where the seal 80 can be replaced. At surface, the drill head 18 and seal 80 are removed from the drill tubing. Then, a replacement seal is installed on the drill tubing and the drill head 18 is reinstalled at the distal end of the drill tubing below the replacement seal. Once the seal is replaced and the drill head is reattached, the drill tubing can be lowered back into wellbore 2 and the replacement seal can engage the sealing assembly as described above.

Figure 9:
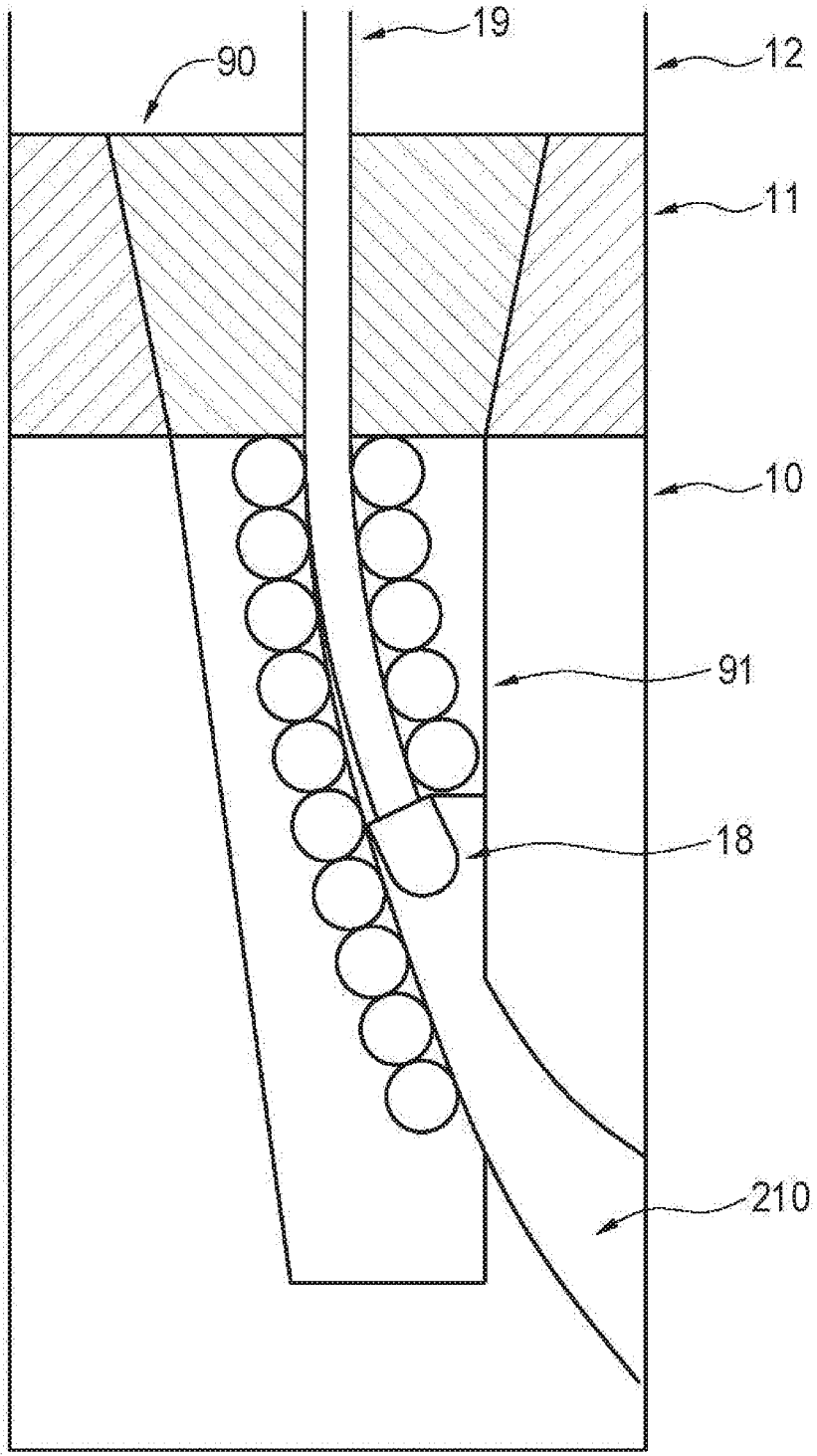
FIG. 9 is a schematic view of a deflection assembly usable with the hydraulic drilling system shown in FIGS. 1 and 2, according to one embodiment of the present invention.

FIG. 9 illustrates a sample whipstock deflection assembly usable with the above described systems. The whipstock includes a whipstock deflection assembly 91 that is replaceable at surface without having to retract the work string from the wellbore. In this embodiment, whipstock 10 has an inner bore for receiving deflection assembly 91. The inner bore is in communication with a passage 210 that leads to a lower opening on the outer surface of a side of whipstock 10. Deflection assembly 91 has an outer surface and an inner curved bore, the latter providing a passage for drill tubing 19.

The drill head 18 of drill tubing 19 has an outer diameter that is a greater than the diameter of the inner bore of deflection assembly 91. Further, the outer surface of deflection assembly 91 and the inner bore of whipstock 10 are shaped such that they mate with and frictionally engage each other, and the inner bore of deflection assembly 91 is in communication with passage 210, when seal deflection assembly 91 is received inside whipstock 10.

For example, as shown in the illustrated embodiment, the inner bore of whipstock 10 and the outer surface of deflection assembly 91 are both generally frustoconically shaped, i.e. the effective outer diameter gradually reduces from an upper end to a lower end. The inner bore of whipstock 10 forms a seat for receiving and mating with deflection assembly 91 and when deflection assembly 91 is seated in whipstock 10, its inner bore is substantially aligned with passage 210 to allow for the continuous passage of the drill tubing from the deflection assembly 91 through the passage 210 to the outer surface of whipstock 10.

In a further embodiment, a recess is formed at the lower opening of the inner bore of deflection assembly 91. A shoulder is provided at the lower opening in the recess of deflection assembly 91.

Seal assembly 11 has an inner bore that is configured to receive and frictionally engage a seal 90. Seal 90 has an inner bore for the passage of drill tubing 19 therethrough. When seal 90 is engaged with seal assembly 11, with drill tubing 19 through the inner bore of seal 90, substantially no fluid can flow from one side to the other side of the seal assembly except through the drill tubing. In one embodiment, seal assembly 11 and seal 90 are shaped and configured as described above with respect to seal assembly 11 and 80, respectively, in FIG. 8. The diameter of the inner bore of seal assembly 11 is sized throughout the length of the inner bore such that at least a portion of the deflection assembly 91 can extend past the lower face of the seal assembly and be received in whipstock 10.

To set up the seal assembly for drilling operations, deflection assembly 91 is placed on the drill tubing and seal 90 is placed on the drill tubing above the deflection assembly 91, with the drill tubing slidably movable through the inner bores of the seal and the deflection assembly. The drill head 18 is connected to the distal end of the drill tubing, below deflection assembly. The drill head 18 is receivable in the recess at the lower opening of deflection assembly 91.

The drill tubing, along with seal 90, deflection assembly 91, and drill head 18, is run into the wellbore inside work string 14. When deflection assembly 91 reaches whipstock 10, deflection assembly 91 is received in the seat of whipstock 10 and frictionally engages same while the drill tubing continues to advance down the work string. When the deflection assembly 91 is received in whipstock 10, seal 90 is also received in and frictionally engages seal assembly 11.

The engagement between seal assembly 11 and seal 90 forms a fluid seal to prevent substantially all fluid flow through seal assembly 11, except via the inside of drill tubing 19. Further, when the deflection assembly 91 is received in whipstock 10, the lower opening of deflection assembly 91 is substantially aligned with passage 210 of whipstock 10, to allow drill head 18 and drill tubing 19 to continue advancing downhole through whipstock 10.

To replace deflection assembly 91 and/or seal 90, the drill tubing 19 is pulled upwards inside the work string and sealingly passes through seal 90. When drill head 18 reaches the recess and abuts against the shoulder in deflection assembly 91, drill head 18 is prevented from passing through the inner bore of the deflection assembly because the outer diameter of drill head 18 is larger than the diameter of the inner bore of the deflection assembly. As the drill tubing 19 continues to retract from the work string, the drill head 18 exerts an upward force on the shoulder of the deflection assembly, until the force is sufficient to disengage and unseat the deflection assembly from the whipstock, and also the seal 90 from the seal assembly. The unseated deflection assembly 91 and seal 90 then move upwards with the drill tubing to surface where deflection assembly 91 and/or seal 90 can be replaced.

At surface, the drill head 18 and deflection assembly 91 and/or seal 90 are removed from the drill tubing. Then, a replacement deflection assembly and/or seal is installed on the drill tubing and the drill head 18 is reinstalled at the distal end of the drill tubing below the deflection assembly. Once the deflection assembly 91 and/or seal 90 is replaced and the drill head is reattached, the drill tubing can be lowered back into wellbore 2 and the deflection assembly and seal 90 can engage the whipstock and the sealing assembly, respectively, as described above.

Figure 10:
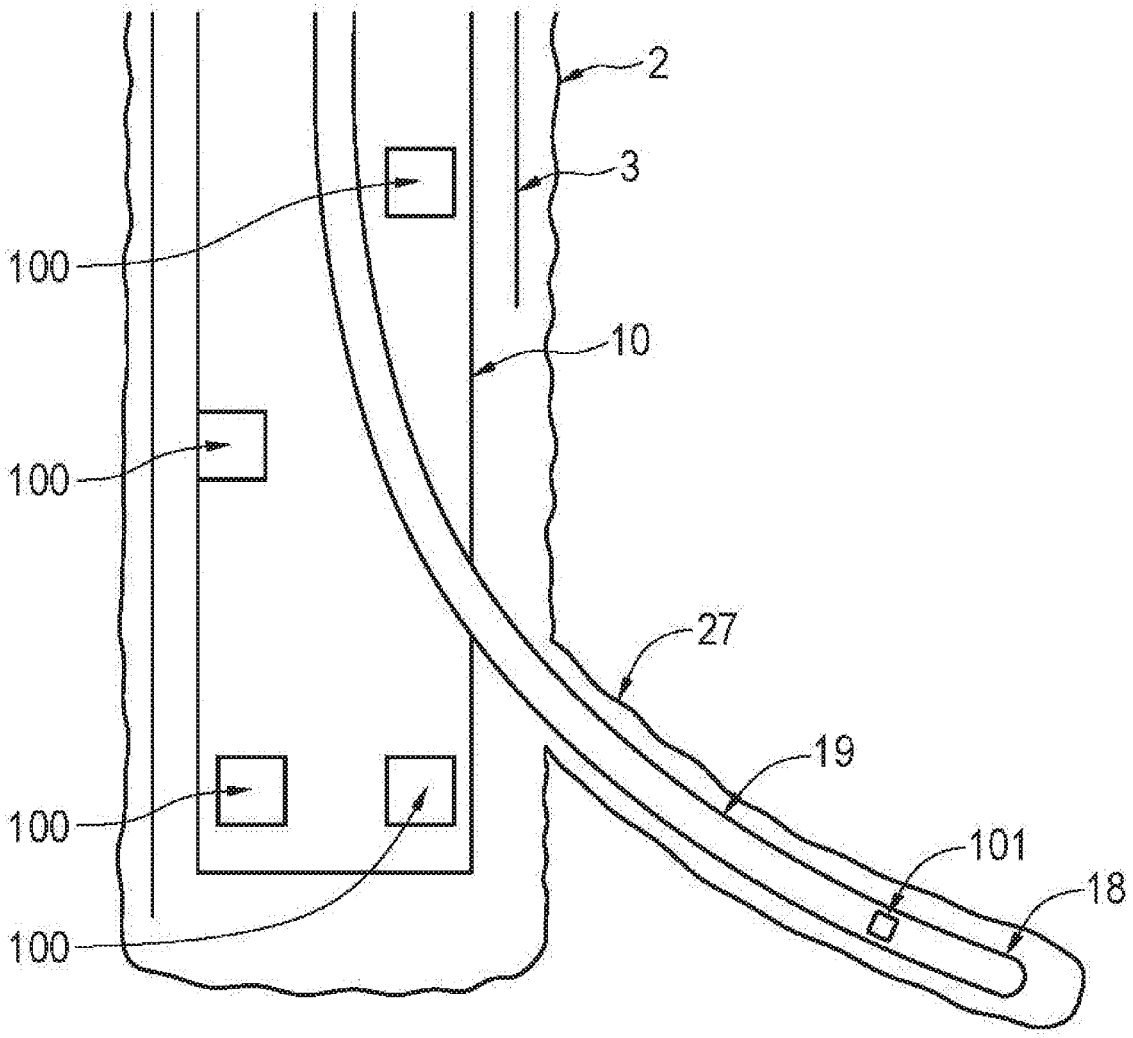
FIG. 10 is a schematic view of an earth measurement system according to one embodiment of the present invention.

FIG. 10 shows a sample earth measurement system that may be used with the above described systems and methods. Sensors (or signal receivers) or other earth measurement devices 100 are installed on the bottom hole assembly 9 or whipstock 10 at various specific locations (i.e. the sensors' location in relation to other components such as the whipstock, the drill head, etc. is known.). The earth measurement system allows various measurements to be taken at one or more distant locations away from the wellbore.

In one embodiment, sensors 100 are acoustic sensors. As borehole 27 is drilled, drill head 18 is extended into borehole 27 such that there is a distance between drill head 18 and whipstock 10. The sound generated by high pressure fluid exiting drill head 18 is received by sensors 100. Acoustic signals generated by sensors 100 may then be processed to triangulate the location of drill head 18. Furthermore, such signals may be processed to determine qualities and parameters of the earth between nozzle 18 and sensors 100. Preferably, two or more sensors are used to determine the location of the drill head two-dimensionally. More preferably, three or more sensors are used perform three-dimensional triangulation.

Alternatively or additionally, a signal source (or signal emitter) 101 is placed on drill head 18 or on tubing 19 near drill head 18. Signal source 101 may be for example a sonic, electrical, magnetic, or radioactive signal source. In an alternative embodiment, the signal source 101 is located on the bottom hole assembly and the sensors 100 are located on or near drill head 18. Sensors 100 are sensors that are capable of sensing the strength and/or existence of the signal emitted by the signal source 101. For example, possible data that can be sensed and collected by sensor 100 may include, for example, sound waves, spontaneous potential, resistivity, neutron density, bulk density, magnetic flux, gamma rays, x-rays, etc. The collection of other measurements is also possible.

The signal transmitted between source 101 and sensor 100 may be used to analyze the physical properties of the earth between source 101 and sensor 100. The physical earth properties that may be determined by the signal transmitted between source 101 and sensor 100 include for example, structure, stress, lithology, porosity, permeability and saturations of water, oil, and gas, etc.

For example, a sonic signal generated by source 101 and sensed by sensor 100 may be used to determine the porosity of the earth between source 101 and sensor 100 using the same principles used by sonic wireline tools. More specifically, sound travels faster through a solid than in a gas or liquid so sound travels through the rock matrix faster than through the pore space (porosity). As such, the time it takes for sound to travel from the source to the sensor varies depending on the porosity of the rock matrix of the surrounding earth. It is therefore possible to calculate the porosity of the rock matrix by determining the speed of sound through the rock matrix. For other measurements, which may include for example spontaneous potential, resistivity, neutron density, bulk density, magnetic flux, and gamma rays, other principles apply.

The measurements determined using the above-described earth measurement system and method may produce different results from wireline tools since the signal passes directly through the rock, whereas with wireline tools the signal passes tangentially through the rock. Therefore, the above-described earth measurement system and method may provide rock properties measurements that are not obtainable from existing wireline technology. For example, x-rays require straight line transmission through the rock matrix so it is not possible for wireline tools that are restricted to a lineal wellbore to use x-rays to determine rock properties.

The measurements taken by an earth measurement device may be stored locally in a recording device (not shown) downhole and/or a recording device positioned remotely at surface outside the wellbore. Measurements may be transmitted to the recording device via radio signals, acoustical signals, and/or a wire. The measurements collected may then be used by an electromagnetic, pressure or acoustical data transmission system. The measurements collected may also be used to generate data on resistivity, water saturation, spontaneous potential porosity, permeability, neutron density, and/or bulk density.

Figure 4A:
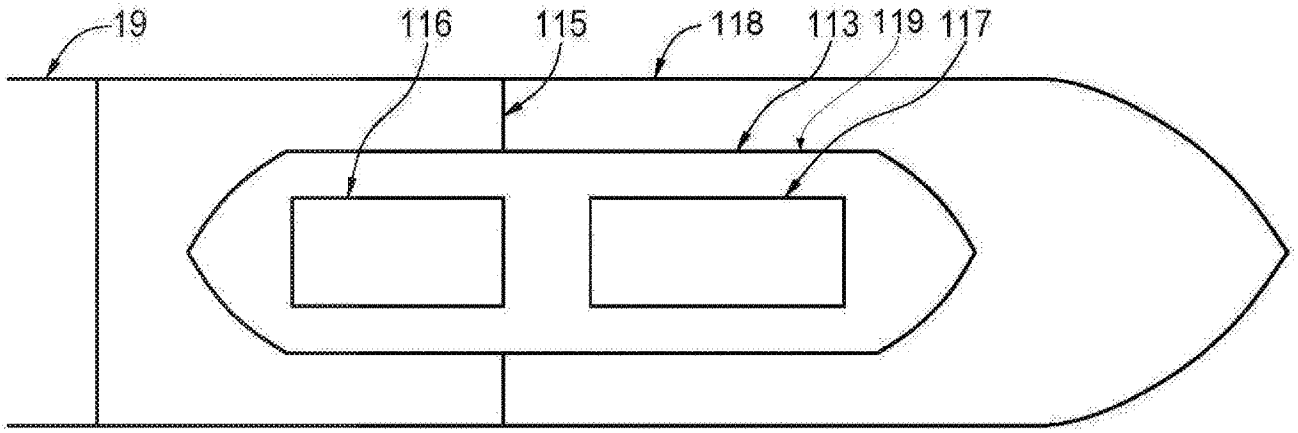
FIG. 4*a* and FIG. 4*b* are a cross-sectional view and an end view, respectively, of a positional device for measuring borehole position according to an embodiment of the present invention.
Figure 4B:
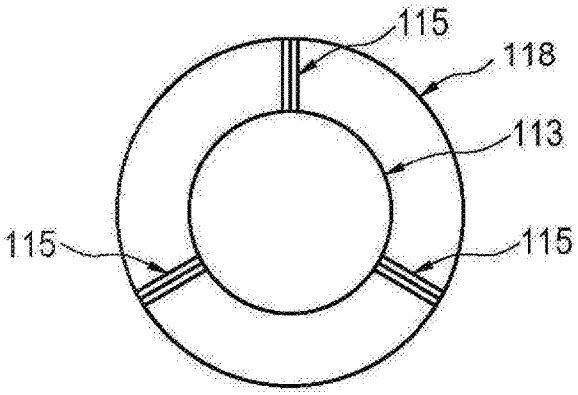

FIGS. 4*a* and 4*b* illustrate a positional measurement device 113 to measure the orientation and location of borehole 27, the distal end of drill tubing 19, and/or whipstock exit 17. In one embodiment, positional device 113 comprises a positional device casing 119, positional measurement components 116, and optionally a power source 117. Components 116 and power source 117 are housed in casing 119, which is designed to withstand operating conditions, such as forces, temperatures and pressures, before, during and after the placement of borehole 27 (FIGS. 1 and 2).

Positional measurement components 116 may be, for example, one or more of gyroscopes, accelerometers, magnetometers, and micro-electronic machines (MEMs). Power source 117, if included in device 113, may be for example batteries. In the illustrated embodiment, positional device components 116 are at or near the proximate end of drill head 118 and power source 117 is at or near the distal end of drill head 118; however, in other embodiments, components 116 and power source 117 may be disposed at different positions relative to drill head 118 or drill tubing 19.

In one embodiment, a positional device suspension 115 suspends positional device casing 119 in drill head 18, which may for instance have an inner diameter of about 1 inch. Positional device suspension 115 provides a physical separation (i.e. an annulus) between the outer surface of the positional device and the inner surface of the drill head, thereby allowing fluid to flow from drill tubing 19, around and past positional device 113 through the annulus, and exit drill head 118 as a high pressure fluid jet. Furthermore, positional device 113 is suspended by suspension 115 in drill head 118 to allow the positional device to be shielded, to some extent, from any plastic and/or elastic deformation that may be experienced by drill head 118.

FIG. 4*b* shows one embodiment where the positional device is suspended concentrically within the drill head; however, concentricity is not required. In a further embodiment, positional device 113 is suspended by suspension 115 in drill tubing 19, rather than inside drill head 118. Drill tubing 19 may have an inner diameter of, for example, about 1 inch. Suspending positional device 113, as described above, allows fluid to flow around it and protects it to some extent from any deformation of the drill tubing.

Figure 11:
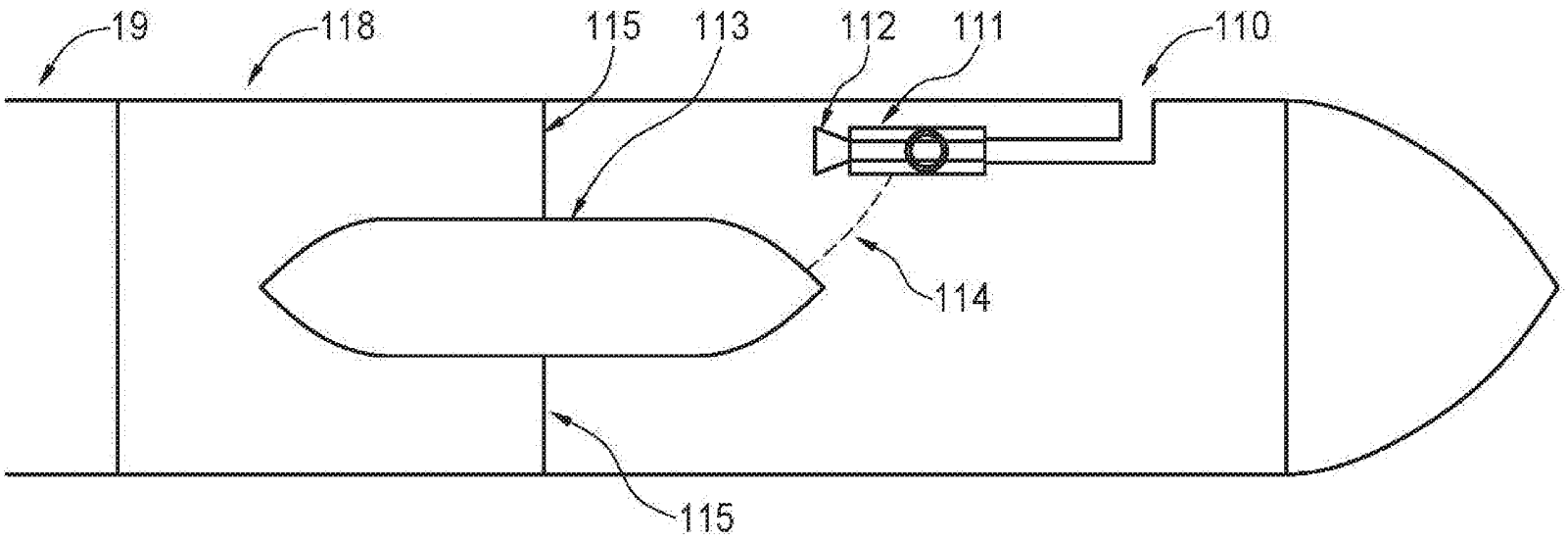
FIG. 11 is a schematic view of a steerable drill head usable with the hydraulic drilling system shown in FIGS. 1 and 2, according to one embodiment of the present invention.

FIG. 11 shows a sample drill head configuration usable with the above described systems and methods. In this embodiment, the drill head is configured to be steerable. A drill head 118 mountable on the distal end of drill tubing 19 has at least one side port 110 that is connected to a valve 111 having a side port inlet 112. A positional device 113 is mounted inside drill head 18 or near the distal end of drill tubing 19. In one embodiment, positional device 113 is mounted using positional device suspension 115, which is as described with respect to FIGS. 4*a* and 4*b*. In an alternative embodiment, the positional device may be suspended inside drill tubing 19, instead of drill head 118, as described above.

Positional device 113 is linked to valve 111 via a connection 114. Connection 114 may be a wired connection or a wireless connection. Connection 114 is used to relay instructions to valve 111 to open or close. When valve 111 is open, a portion of the flow in drill head 118 is directed into inlet 112, through valve 111 and exits port 110 as a high pressure fluid jet. This high pressure fluid jet generates a force that is sufficient to steer drill head 118 in a direction away from the fluid jet exiting from port 110. Positional device 113 may include a processor, which may be preprogrammed with specific commands, such as keeping horizontal, heading in a downward direction, etc. Alternatively or additionally, the processor may be in communication with surface equipment to which it may transmit positional information about the drill head and from which it may receive steering instructions.

Figure 12B:
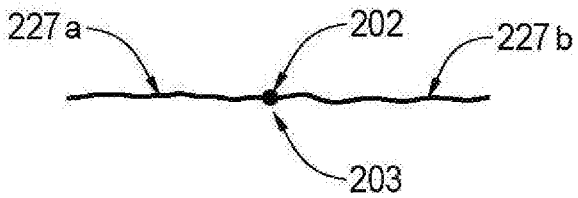
FIGS. 12*a* and 12*b* are a plan view and end view, respectively, of sample borehole orientations in a horizontal well, according to one embodiment of the present invention.
Figure 12A:
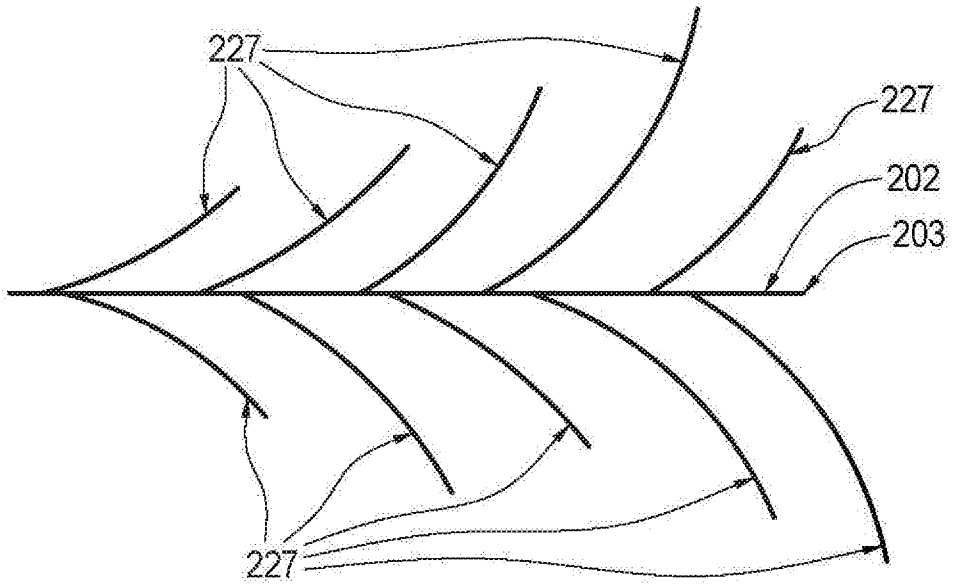

A sample embodiment of borehole placement relative to a wellbore is shown in FIGS. 12*a* and 12*b*. Wellbore 202 is a substantially horizontal wellbore and may or may not include a casing 203. At least one borehole 227 is drilled outwardly from wellbore 202. The borehole 227 has a direction, a length, and a curvature. When viewed from one end of the wellbore 202 down the central long axis, as shown for example in FIG. 12*b*, borehole 227*a* extends substantially horizontally away from the wellbore 202.

In one embodiment, a plurality of boreholes 227 are positioned intermittently along the length of wellbore 202, and the boreholes extend substantially horizontally outwardly from wellbore 202 in substantially the same horizontal plane. Preferably, the lowermost borehole is drilled first and the next borehole above the lowermost borehole is drilled, and so on, such that the boreholes 227 are drilled sequentially from the lowermost borehole to the uppermost borehole.

In a further embodiment, after a first borehole 227 is drilled and the drill head is retracted therefrom, the whipstock may be rotated about the long central axis of the bottom hole assembly by an angle, for example about 180 degrees, and the drill head is then once again advanced to drill a second borehole. The second borehole is at substantially the same axial location along the length of wellbore 202, but extends at an angle away the first borehole due to the rotation of the whipstock. In the illustrated embodiment shown in FIG. 12*b*, a first borehole 227*a* is angled apart from a second borehole 227*b* by about 180 degrees.

After one or more boreholes are drilled at an axial location of the wellbore, the bottom hole assembly 9 may be moved to another axial location along the wellbore, preferably in the direction towards the proximate end, where additional borehole(s) may be drilled as desired. Bottom hole assembly 9 is moved axially in wellbore 2 or casing 3 by shortening or lengthening work string 14. If work string 14 is comprised of threaded casing, tubing, or pipe, then joints of the threaded casing, tubing, or pipe are removed or added to the proximate end of the work string to place the bottom hole assembly 9 at the desired axial position downhole.

The placement of a plurality of boreholes 227 extending from wellbore 202 may allow the wellbore to cover more surface area across a horizontal plane compared to that of a single lineal wellbore.

There are many possible applications and/or usages for a wellbore having a plurality of radially outwardly extending boreholes in the horizontal plane. For example, wellbore 202 may be one of the wells in a well pair in a steam assisted gravity drainage (SAGD) operation. Such an arrangement of boreholes in a SAGD well may be used to alter the shape and performance of the steam chamber. In another embodiment, wellbore 202 may be a well that is situated between a pair of SAGD wells. This borehole arrangement may enhance early well performance by accessing warm parts of the reservoir. Wellbore 202 may also be a well for use in cyclic steam stimulation (CSS). In steam processes, borehole configurations described herein may access additional reservoir and allow steam to reach and heat extended parts of the reservoir, thereby making the steam process more efficient and effective.

One or more of the plurality of boreholes may be positioned at or near the distal end of a vertical, deviated or horizontal wellbore.

Figure 13B:
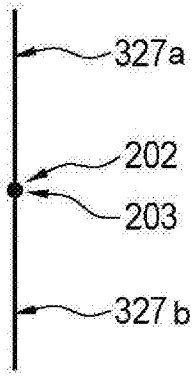
FIGS. 13*a* and 13*b* are a plan view and end view, respectively, of sample borehole orientations in a horizontal well, according to another embodiment of the present invention.
Figure 13A:
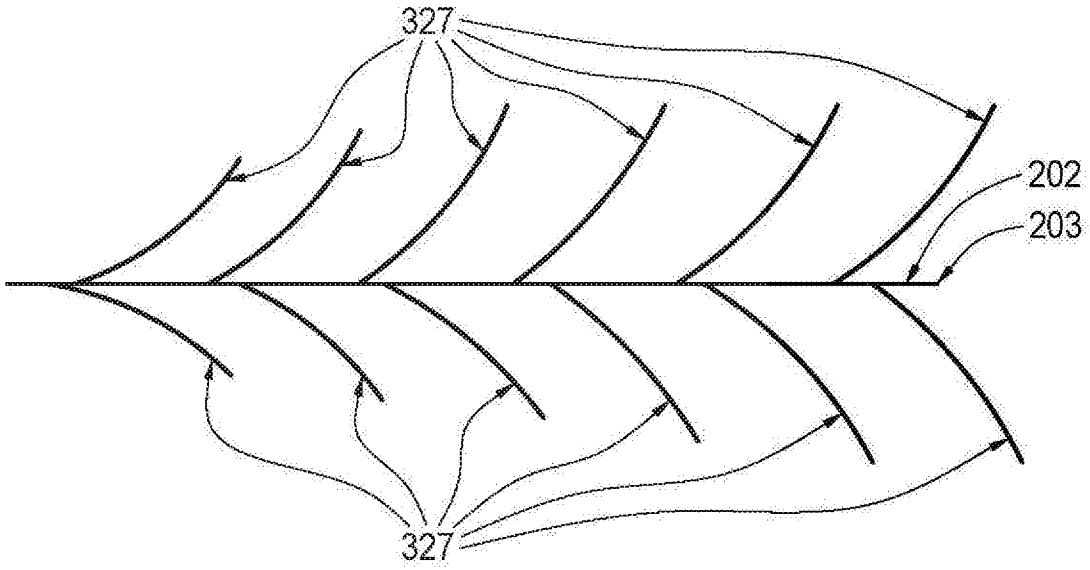

Another sample embodiment of borehole placement relative to a wellbore is shown in FIGS. 13*a* and 13*b*. Wellbore 202 is a substantially horizontal wellbore and may or may not include a casing 203. At least one borehole 327 is drilled outwardly from wellbore 202. The borehole 327 has a direction, a length, and a curvature. When viewed from one end of the wellbore 202 down the central long axis, as shown for example in FIG. 13*b*, borehole 327*a* extends substantially vertically away from the wellbore 202.

In one embodiment, a plurality of boreholes 327 are positioned intermittently along the length of wellbore 202, and the boreholes extend substantially vertically outwardly from wellbore 202 in substantially the same vertical plane. Preferably, the lowermost borehole is drilled first and the next borehole above the lowermost borehole is drilled, and so on, such that the boreholes 327 are drilled sequentially from the lowermost borehole to the uppermost borehole.

In a further embodiment, after a first borehole 327 is drilled and the drill head is retracted therefrom, the whipstock may be rotated about the long central axis of the bottom hole assembly by an angle, for example about 180 degrees, and the drill head is then once again advanced to drill a second borehole. The second borehole is at substantially the same axial location along the length of wellbore 202, but extends at an angle away the first borehole due to the rotation of the whipstock. In the illustrated embodiment shown in FIG. 13*b*, a first borehole 327*a* is angled apart from a second borehole 327*b* by about 180 degrees.

After one or more boreholes are drilled at an axial location of the wellbore, the drilling components (i.e. drill tubing and drill head) may be moved to another axial location along the wellbore, preferably in the direction towards the proximate end, where additional borehole(s) may be drilled as desired.

The plurality of boreholes 327 extending from wellbore 202 may allow the wellbore to cover more surface area across a vertical plane compared to that of a single lineal wellbore.

There are many possible applications and/or usages for a wellbore having a plurality of radially outward extending boreholes in a vertical plane. For example, wellbore 202 may be a horizontal well. Many horizontal wells undulate upon drilling and may extend in and out of the desired level in the formation. Vertical plane boreholes can reach up or down to reach the desired level. In another embodiment the well may be a well in a steam assisted gravity drainage (SAGD) operation. The presence of horizontal shale layers can impede the orderly development of steam chambers. Vertical boreholes may be used to penetrate these shale layers which may help promote the development of steam chambers. In another embodiment, boreholes that are not necessarily vertical (e.g. curved, horizontal, diagonal, etc.) may be used to penetrate the shale layers.

Figure 14A:
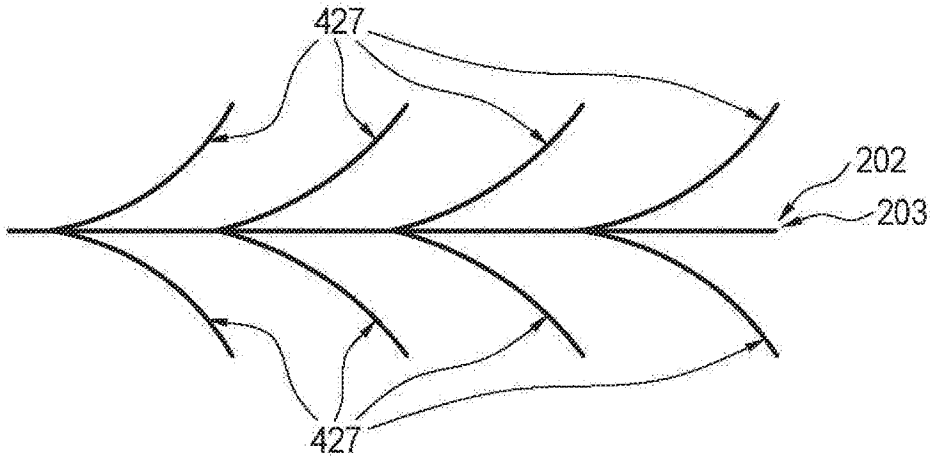
FIGS. 14*a*, 14*b*, and 14*c* are a plan view, an elevation view, and an end view, respectively, of sample borehole orientations in a horizontal well, according to yet another embodiment of the present invention.
Figure 14B:
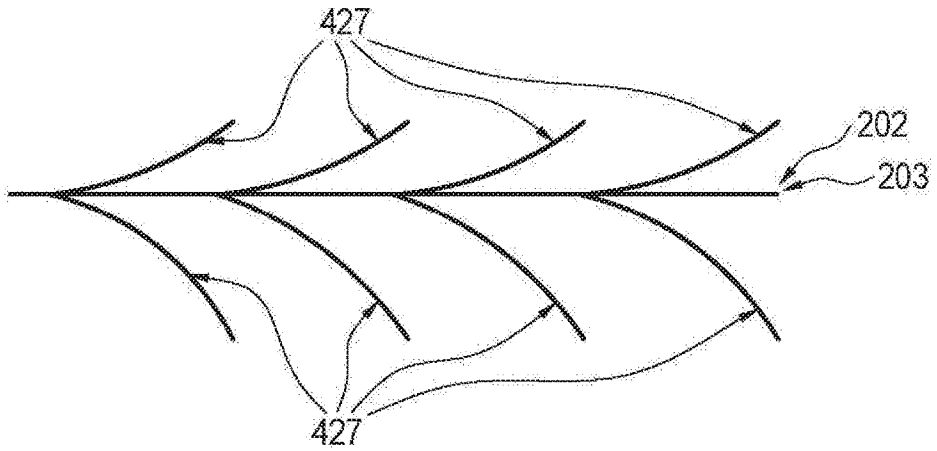
Figure 14C:
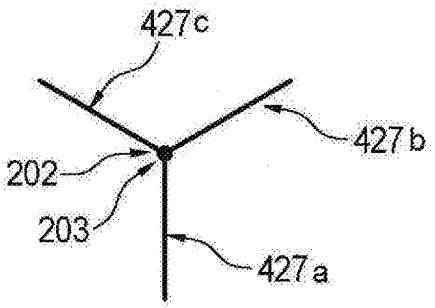

Yet another sample embodiment of borehole placement relative to a wellbore is shown in FIGS. 14*a*, 14*b*, and 14*c*. Wellbore 202 is a substantially horizontal, substantially vertical, or deviated wellbore and may or may not include a casing 203. At least one borehole 427 is drilled outwardly from wellbore 202. The borehole 427 has a direction, a length, and a curvature. When viewed from one end of the wellbore 202 down the central long axis, as shown for example in FIG. 14*c*, borehole 427*a* extends away from the wellbore 202 at an angle between the vertical and the horizontal (an "oblique" angle).

In one embodiment, a plurality of boreholes 427 are positioned intermittently along the length of wellbore 202, and the boreholes may extend substantially vertically, substantially horizontally, or obliquely outwardly from wellbore 202. Preferably, the lowermost borehole is drilled first and the next borehole above the lowermost borehole is drilled, and so on, such that the boreholes 427 are drilled sequentially from the lowermost borehole to the uppermost borehole. When viewed from one end of the wellbore 202, each borehole may or may not extend at the same angle as another borehole.

In a further embodiment, after a first borehole 427*a* is drilled and the drill head is retracted therefrom, the whipstock may be rotated about the long central axis of the bottom hole assembly by an angle, for example about 120 degrees, and the drill head is then once again advanced to drill a second borehole. The second borehole is at substantially the same axial location along the length of wellbore 202, but extends at an angle away the first borehole due to the rotation of the whipstock. Additional boreholes may be drilled from substantially the same axial location in the wellbore by repeating this process of rotating the whipstock and drilling. For example, in the illustrated embodiment shown in FIG. 14*c*, a first borehole 427*a* is angled apart from a second borehole 427*b* by about 120 degrees, and the second borehole 427*b* is angled apart from a third borehole 427*c* by about 120 degrees.

After one or more boreholes are drilled at an axial location of the wellbore, the drilling components (i.e. drill tubing and drill head) may be moved to another axial location along the wellbore, preferably in the direction towards the proximate end, where additional borehole(s) may be drilled as desired.

The plurality of boreholes 427 extending from wellbore 202 at various angles may allow the wellbore to cover more surface area compared to that of a single lineal wellbore and may allow the wellbore to be connected to other formations and/or structures in the earth, including for example other wellbores, tunnels, caves, etc.

Figure 15B:
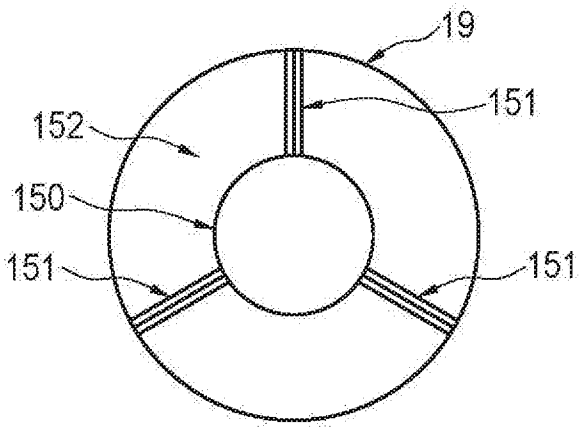
FIGS. 15*a* and 15*b* are a schematic elevation view and an end view of an earth measurement system according to one embodiment of the present invention.
Figure 15A:
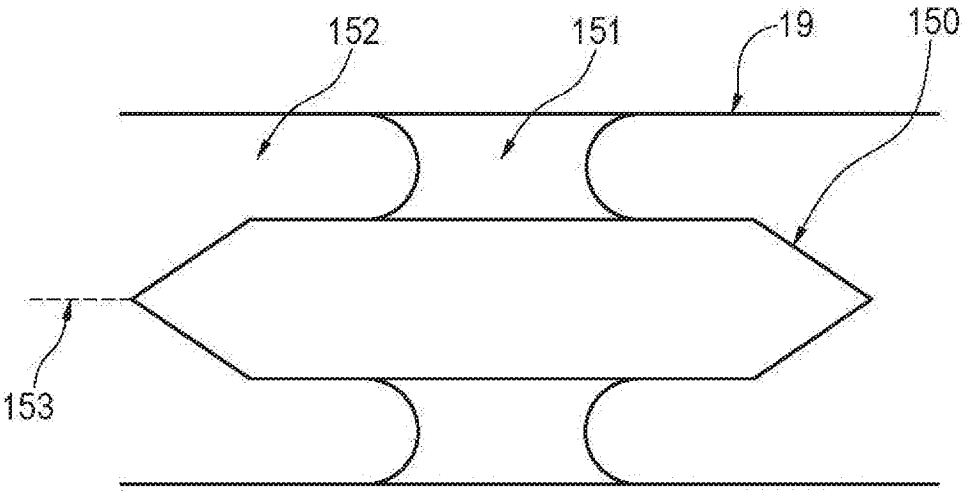

Referring to FIGS. 15*a* and 15*b*, a sample earth measurement system is shown. The system includes a measurement device 150 that is installed inside drill tubing 19 but does not block fluid flow therethrough. In one embodiment, as illustrated in FIGS. 15*a* and 15*b*, measurement device 150 is mounted inside drill tubing 19 and is connected to the inner wall of drill tubing 19 by braces 151. In the illustrated embodiment, braces 151 are spaced apart to provide passages 152, formed between the outer surface of device 150 and the inner wall of drill tubing 19, to allow fluid inside the drill tubing to flow past device 150 towards drill head 18.

In a further embodiment, measurement device 150 may not be connected to the drill tubing 19 or drill head 18, but rather is loose within the drill tubing or is tethered in some manner from above.

Measurement device 150 may be used to measure any of: fluid flow, stress, strain, position, pressures, temperatures, acoustical energy, magnetic flux, spontaneous potential, resistivity, other electrical signals, electromagnetic signals, radiation, such as radio signals, x-rays or gamma rays or any other such measurement as desired. In a sample embodiment, earth measurement device 150 is a fiber optics cable. For example, fluid flow may be measured using a temperature profile obtained via a fiber optics cable. Measurement device 150 may be connected to a remote site by a communication link 153, which may be electrical, electromagnetic or acoustical in nature, and wired or wireless, or measurements may be stored on board of the measurement device for subsequent download.

The measurement device may be placed downhole simultaneously as a borehole is being formed. The measurement device may also take measurements while the borehole is being formed. For example, a measurement device placement apparatus as described hereinbelow may be used to hydraulically inject the measurement device downhole, e.g. down the drill tubing or in the borehole.

Further, the measurement device may be placed downhole after the borehole has been drilled. This may be achieved by, for example, a measurement device placement apparatus as described hereinbelow. Before placing the measurement apparatus downhole via the drill tubing, and depending on the size of the measurement device, it may be necessary to remove the drill head to allow the measurement device to exit the distal end of the drill tubing. In one embodiment, the drill head is removed by raising the internal pressure within the drill tubing. Alternatively or additionally, a solid material or abrasives may be added to the drilling fluid to fracture or erode the drill head.

Figure 16A:
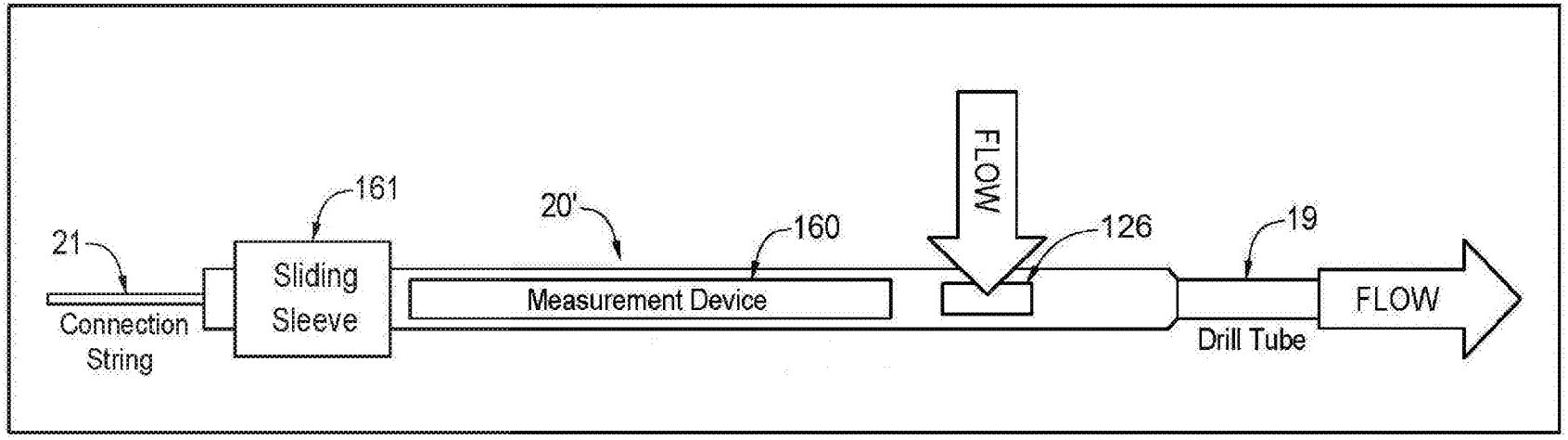
FIGS. 16*a* and 16*b* are schematic views of an apparatus, in a standby position and a launch position, respectively, for placing an earth measurement device into the drill tubing according to an embodiment of the present invention.
Figure 16B:
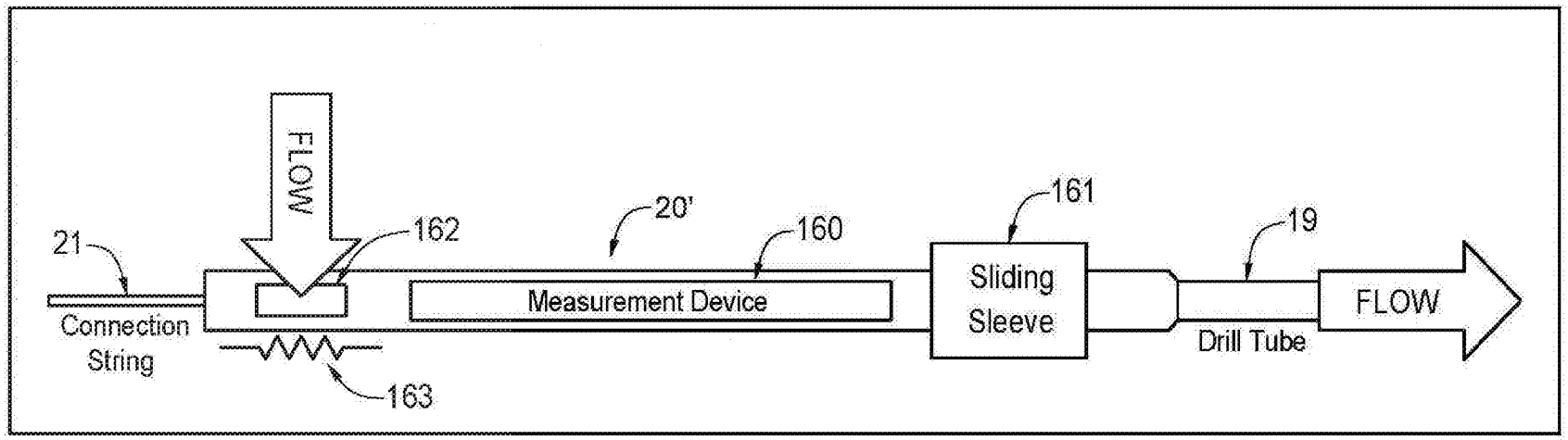

FIGS. 16*a* and 16*b* show a measurement device placement apparatus 20' usable with the above described system 120 (shown in FIG. 1), the device being configured for placing an earth measurement device. The placement apparatus 20' has a proximate end connected to the connection string 21 and a distal end connected to drill tubing 19. Placement apparatus 20' has a lower conduit 126 near its distal end and an upper conduit 162 near its proximate end. The placement apparatus 20' further includes a sliding sleeve 161 and a spring 163. The placement apparatus 20' has two positions: a standby position (as shown in FIG. 16*a*) and a launch position (as shown in FIG. 16*b*).

In the standby position, a measurement device 160 is placed inside placement apparatus 20', near the proximate end thereof such that conduit 126 is below device 160. Measurement device 160 may be held in place inside the placement apparatus by a retention mechanism, such as for example a magnet, spring, wire or cable, or a combination thereof. Spring 163 is provided above the measurement device and exerts a constant force on the device 160 in the direction of the drill tubing 19. The spring 163 is selected with a spring constant that is not sufficient to overcome the retention mechanism holding device 160 in place. In one embodiment, sleeve 161 covers upper conduit 162 to restrict fluid flow therethrough, while lower conduit 126 is left open to allow fluid flow therethrough.

In the launch position, measurement device 160 is released from the retention mechanism. In one embodiment, the retention mechanism is an electromagnet, to which power is supplied to hold measurement device 160 in place. To release the measurement device, power to the electro magnet is cut off by a signal from the surface, thereby allowing spring 163 to push the device 160 towards the distal end of the placement apparatus 20' and down drill tubing 19.

In another embodiment, the retention mechanism is a wire or cable, and the wire or cable is tensioned to hold the measurement device in place. To release the measurement device, the tension in the wire or cable is released or lessened to allow the constant force exerted by spring 163 on device 160 to push the device 160 towards the distal end of the placement apparatus 20' and down drill tubing 19.

Optionally, in the launch position, sliding sleeve 161 moves towards the distal end of the placement apparatus to cover lower conduit 126 to restrict fluid flow therethrough, which consequently opens upper conduit 162 to allow fluid flow therethrough. With upper conduit open, fluid can flow therethrough into the placement apparatus from above the measurement device 160, thereby exerting a hydraulic force on the device 160 to help push it into drill tubing 19 towards the distal end of drill tubing 19.

Figure 17:
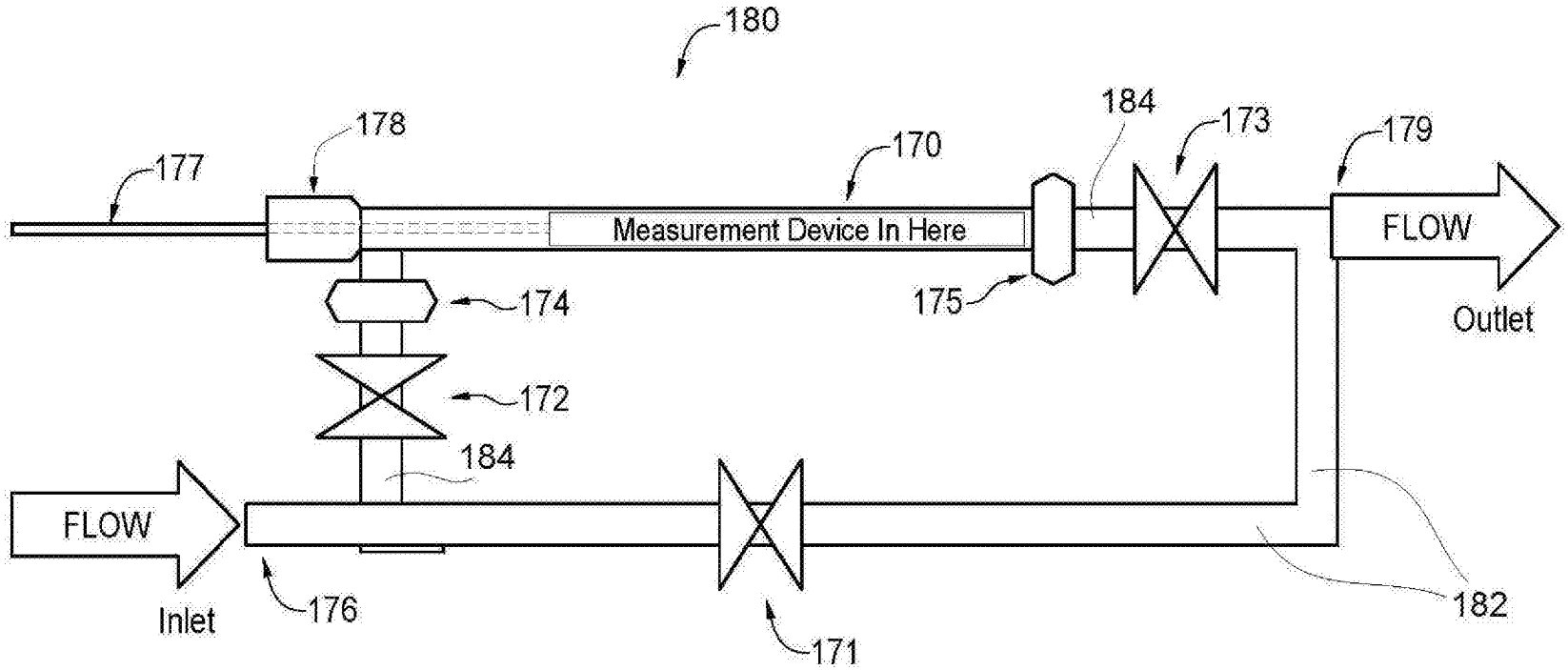
FIG. 17 is a schematic view of an apparatus for placing an earth measurement device into the drill tubing according to another embodiment of the present invention.

FIG. 17 illustrates a sample measurement device placement apparatus usable with the above described system 220 (shown in FIG. 2). Measurement device placement apparatus 180 comprises a first tubing 182, providing a first flow path, and a second tubing 184, providing a second flow path. Apparatus 180 is installable at an axial location between high pressure fluid source 24 and the proximate end of drill tubing 19'. Each of the first tubing and second tubing has an upper end and a lower end, with both ends in fluid communication with drill tubing 19', such that when fluid is injected down drill tubing 19' at least some fluid flows through measurement placement device 180.

In the illustrated embodiment, the upper ends of both tubings 182 and 184 are connected to and in fluid communication with an inlet 176 and the lower ends of both tubings 182 and 184 are connected to and in fluid communication with an outlet 179. Inlet 176 and outlet 179 are in the flow path of and in fluid communication with drill tubing 19', with outlet 179 being downstream from inlet 176.

First tubing 182 has a valve 171. When valve 171 is open, fluid is allowed to flow through first tubing 182. When valve 171 is closed, fluid flow through first tubing 182 is restricted.

Second tubing 184 has a first valve 172 and a second valve 173. When each valve is open, the valve allows fluid flow therethrough. When the valve is closed, the valve restricts fluid flow therethrough. A measurement device 170 is placeable between the first valve 172 and the second valve 173. In a sample embodiment, device 170 may be placed between the valves by using a first coupling 174 and a second coupling 175, with the first coupling positioned between one end of the device 170 and the first valve 172, and the second coupling positioned between the other end of the device and the second valve 173. Valves 172 and 173, and optionally couplings 174, 175, provide a retention mechanism for keeping device 170 inside second tubing 184.

Optionally, second tubing 184 includes a seal 178 between valves 172 and 173 which allows for the substantially fluidly-sealed passage of a control string 177 connectable to the measurement device 170. When connected to device 170 through seal 178, the control string 177 may be used to control the descent of the device 170 and/or to retrieve the device 170 back to the surface. Control string 177 may also be used to communicate with the device 170 and/or to retrieve data therefrom. The control string 177 may be for example a flexible wire, cable, continuous rod, coiled tubing, etc.

In operation, measurement device 170 is placed between valves 172 and 173 of second tubing 184. As mentioned above, control string 177 may be connected to device 170. Apparatus 180 has two positions: a standby position and a launch position. In the standby position, valves 172 and 173 are closed and valve 171 is open. Fluid passes through apparatus 180 and down drill tubing 19' by entering inlet 176 and existing outlet 179 via tubing 182 past valve 171. Because valves 172 and 173 are closed, the fluid bypasses the measurement device 170 and the measurement device is held in place inside apparatus 180.

In the launch position, valve 171 is closed and valves 172 and 173 are opened. Fluid flows through apparatus 180 and down drill tubing 19' by entering inlet 176 and flowing into tubing 184, while bypassing tubing 182 due to the closure of valve 171. The flow of fluid into tubing 184 pushes measurement device through the open valve 173 and eventually outlet 179, and into the drill tubing 19' below apparatus 180. If control string 177 is connect to the device 170, the control string stays connected to the device 170 as the device 170 exits the apparatus 180 and moves down the drill tubing 19'.

In one embodiment, the earth measurement device is fitted with an anchor for affixing itself to the earth, after it is deployed into the earth by the placement apparatus.

The above description regarding the placement and installation of the earth measurement device, especially with reference to FIGS. 15 to 17, is also applicable to earth manipulation devices, as described above. More specifically, an earth manipulation device may be placed downhole using a placement apparatus such as those described with respect to FIGS. 16 and 17. Further, the drill head may be removed as described above prior to placing the earth manipulation device. The earth manipulation device may include an anchor for affixing itself to earth after deployment. The earth manipulation device may also be connected to a control string.

Figure 20A:
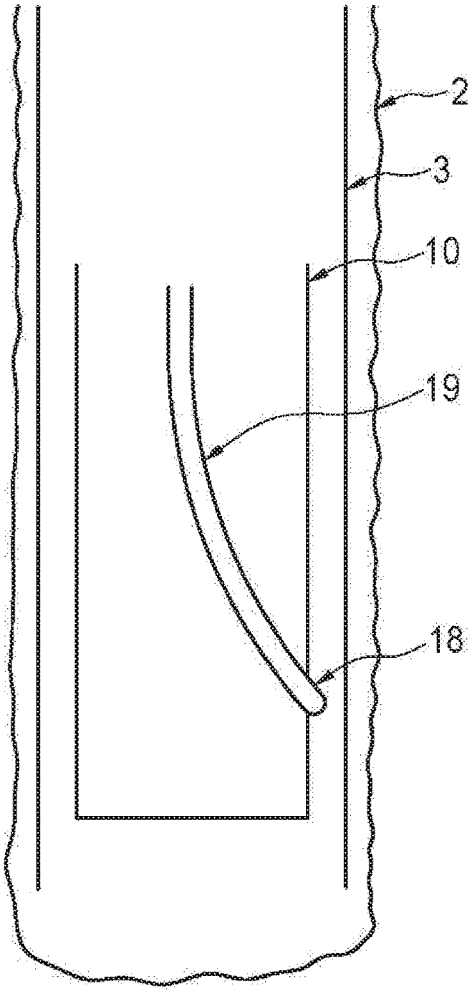
FIGS. 20*a* and 20*b* are schematic sequential views of a perforated casing resulting from the use of a hydraulic drilling method in accordance with one embodiment of the present invention.
Figure 20B:
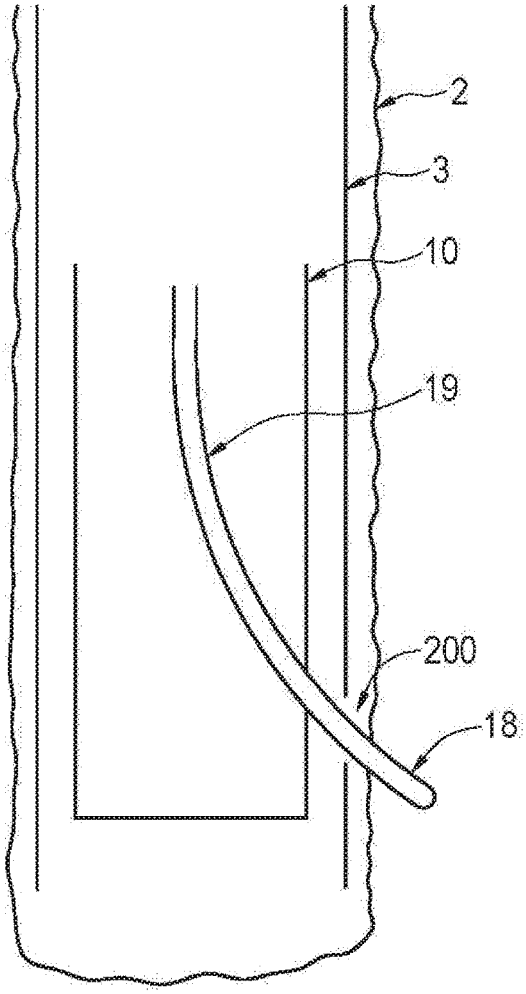

With reference to FIGS. 20*a* and 20*b*, a method for perforating casing and placing an extended borehole comprises positioning drill head 18 at the lower opening of whipstock 10; injecting drilling fluid with abrasive material into drill tubing 19; and ejecting the drilling fluid from drill head 18 as a high pressure abrasive cutting jet. The high pressure abrasive cutting jet cuts a hole in casing 3 of suitable size and shape to allow the drill head and drilling tubing to pass therethrough into the earth where an extended borehole is to be drilled. An extended borehole is more than a few feet in length. Drill head 18 may be built of suitable material to withstand abrasives, including for example, hardened steel, ceramics or tungsten carbide. Drill head 18 may also be capable of rotation to decrease cutting time and direct the high pressure abrasive cutting jet to form a clean, full sized hole for the passing therethrough of drill head 18 and drill tubing 19.

The present invention may be used in wellbores in various applications including for example, steam assisted gravity drainage (SAGD), cyclic steam stimulation (CSS), etc.

LIST OF ITEMS CONTAIN IN THE FIGURES

1. Surface
2. Wellbore
3. Casing
4. Wellhead flange
5. Earth
6. Wellhead control equipment
7. Rotational Device
8. Rotating flange
9. Bottom hole assembly
10. Whipstock
11. Seal assembly
12. Anchor
13. Extendable work string
14. Work string
15. Hanger
16. Sealing element
17. Whipstock exit
18. Drill head
19. Drill tubing
19'. Drill tubing
20. Flow-through device
20'. Placement apparatus
21. Connection string
22. Movement control device
23. Inner annulus
23'. Inner annulus
24. High pressure fluid source
25. Inlet
26. Conduit
27. Borehole
28. Seal
29. Outlet
30. Outlet valve
31. Rotational device splines
32. Work string splines
40. Anchor piston
41. Seal
42. Annulus
60. Centralizer
61. Swivel
62. Weight
63. Drive Mechanism
70. Wheel
71. Tread
72. Drive mechanism
80. Seal
90. Seal
91. Deflection assembly
100. BHA sensor/source
101. Drill head or drill tubing sensor/source
102. Upper section
104. Lower section
110. Side port
111. Valve
112. Side port inlet
113. Positional device
114. Communications link
115. Positional device suspension
116. Positional measurement components
117. Power source
118. Drill head
119. Positional device casing
120. System
126. Lower conduit
150. Measurement device
151. Bracing
152. Annulus
153. Communications link
160. Measurement device
161. Sliding Sleeve
162. Upper conduit
163. Spring
170. Measurement device
171. Valve
172. Valve
173. Valve
174. Coupling
175. Coupling
176. Inlet
177. Control string
178. Seal
179. Outlet
180. Apparatus
182. First tubing
184. Second tubing
190. Earth
192. Ice
194. Fracture material
202. Wellbore
203. Casing
205. Passage
210. Passage
220. System
227. Borehole
327. Borehole
427. Borehole The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims. For US patent properties, it is noted that no claim element is to be construed under the provisions of 35 USC 112, sixth paragraph, unless the element is expressly recited using the phrase "means for" or "step for".

The invention claimed is:

1. A hydraulic drilling system for use with a wellbore having an inner surface, the system comprising:

a first work string for placement down the wellbore, the first work string having an inner surface defining an axially extending bore, a proximate end, and a distal end;

an upper section having an inner bore, the upper section being engaged to the proximate end of the first work string and the position of the upper section being fixed relative to the wellbore;

a whipstock provided at the distal end of the first work string, the whipstock having a long central axis, a whipstock exit and an inner bore providing a passage from the bore of the first work string to the whipstock exit;

a movement control device;

wheels or treads on an outer surface of the whipstock for frictionally engaging the inner surface of the wellbore;

a drive mechanism coupled to the whipstock for driving the wheels or treads;

an upper swivel and a lower swivel and the whipstock being mounted between the upper swivel and the lower swivel, thereby allowing the whipstock to rotate about the long central axis; and a drill tubing extending inside the first work string and having an inner bore leading to an opening at a distal end of the drill tubing, and the drill tubing being extendable through the inner bore of the whipstock, such that the opening is extendable through the whipstock exit, the advancement and retraction of the drill tubing relative to the whipstock being controlled by the movement control device, the whipstock being selectively actively conveyable in an axial direction relative to the wellbore by operation of the drive mechanism, and the drill tubing allowing fluid to pass therethrough via the upper section.

2. The system of claim 1 further comprising a second work string that is extendable and contractible in an axial direction of the first work string, the second work string forms a length of the first work string at an axial location between the proximate end and the distal end of the first work string, for accommodating at least a portion of any axial forces on the first work string.

3. The system of claim 1 wherein drive mechanism is powered by hydraulic energy generated by fluid flow through the first work string.

4. The system of claim 1 wherein a first set of the wheels or treads is coupled on an upper end of the whipstock and a second set of the wheels or treads is coupled on a lower end of the whipstock and the upper swivel and the lower swivel are positioned between the first set and the second set of the wheels or treads.

5. The system of claim 1 wherein the wheels or treads are spring loaded and aligned axially and circumferentially to act as a centralizer for the whipstock.

6. The system of claim 1 wherein the drive mechanism further acts to drive rotation of the whipstock between the upper swivel and the lower swivel.

7. The system of claim 1 wherein the whipstock is rotatable about the long central axis by use of the upper swivel and the lower swivel without moving the wheels or treads.

8. The system of claim 1 wherein the whipstock is eccentrically weighted such that the whipstock exit is biased in a particular radial direction by the force of gravity.

9. The system of claim 1 wherein a first set of the wheels or treads is coupled on an upper end of the whipstock and a second set of the wheels or treads is coupled on a lower end of the whipstock and the upper swivel and the lower swivel are positioned between the first set and the second set of the wheels or treads and the first set and the second set of the wheels or treads are spring loaded and aligned axially and circumferentially to act as a centralizer for the whipstock and such that the whipstock is rotatable freely about the long central axis while being supported by the first set and the second set of the wheels or treads.

10. The system of claim 9 wherein the drive mechanism further acts to drive rotation of the whipstock between the upper swivel and the lower swivel.

11. The system of claim 1 further comprising a portion of the first work string that is extendable and contractible in an axial direction of the first work string, the portion being configured to accommodate axial movement of the whipstock by the wheels or treads the proximate end and the position of the upper section remain fixed relative to the wellbore.

* * * * *